US011433680B2

(12) United States Patent
Horii et al.

(10) Patent No.: US 11,433,680 B2
(45) Date of Patent: Sep. 6, 2022

(54) LIQUID-SEALED CARTRIDGE AND LIQUID SENDING METHOD

(71) Applicants: SYSMEX CORPORATION, Kobe (JP); ASTI CORPORATION, Hamamatsu (JP)

(72) Inventors: Kazuyoshi Horii, Kobe (JP); Shun Nakamoto, Kobe (JP); Noriyuki Ogai, Hamamatsu (JP); Yasuhiro Toda, Hamamatsu (JP); Kimiaki Iwahori, Hamamatsu (JP)

(73) Assignees: SYSMEX CORPORATION, Kobe (JP); ASTI CORPORATION, Shizuoka-Ken (JP)

( * ) Notice: Subject to any disclaimer, the term of this patent is extended or adjusted under 35 U.S.C. 154(b) by 0 days.

(21) Appl. No.: 17/032,247

(22) Filed: Sep. 25, 2020

(65) Prior Publication Data

US 2021/0094303 A1 Apr. 1, 2021

(30) Foreign Application Priority Data

Sep. 27, 2019 (JP) ..... JP2019-176472

(51) Int. Cl.
*B41J 2/175* (2006.01)

(52) U.S. Cl.
CPC ..... *B41J 2/17536* (2013.01); *B41J 2/17523* (2013.01)

(58) Field of Classification Search
CPC ..... B41J 2/17503; B41J 2/17523; B41J 2/17536; B41J 2/17596; B01L 3/502738;
(Continued)

(56) References Cited

U.S. PATENT DOCUMENTS 6,079,823 A * 6/2000 Droege ..... B41J 2/17523 347/85
6,893,612 B2 * 5/2005 Kacian ..... B01L 3/50825 422/570

(Continued)

FOREIGN PATENT DOCUMENTS

EP 2548646 A2 1/2013
EP 1289658 7/2017

(Continued)

OTHER PUBLICATIONS

The extended European search report dated Feb. 10, 2021 in a counterpart European patent application No. 20198039.8.

(Continued)

*Primary Examiner* — Anh T Vo
(74) *Attorney, Agent, or Firm* — Crowell & Moring LLP

(57) ABSTRACT

Disclosed is a liquid-sealed cartridge that includes: a liquid storage portion configured to store liquid; a flow path in which the liquid stored in the liquid storage portion flows; and a liquid sealing portion configured to seal the liquid in the liquid storage portion, in which the liquid sealing portion has an outer circumferential portion and a center-side low strength portion disposed closer to a center than the outer circumferential portion, and the center-side low strength portion is broken when pressed, to allow the liquid in the liquid storage portion to flow in the flow path.

17 Claims, 18 Drawing Sheets

(58) Field of Classification Search
CPC ..... B01L 2200/0689; B01L 2200/16; B01L 2200/147; B01L 2300/0803; B01L 2300/021; B01L 2300/123; B01L 2300/1805; B01L 2400/0409
See application file for complete search history.

(56) References Cited

U.S. PATENT DOCUMENTS

| | | | | |
|---|---|---|---|---|
| 7,964,161 | B2 | 6/2011 | Kadel et al. | |
| 8,574,213 | B2 * | 11/2013 | Thilly | B65D 51/241 604/411 |
| 8,703,070 | B1 | 4/2014 | Parng et al. | |
| 9,751,318 | B2 * | 9/2017 | Iwano | B41J 2/1752 |
| 10,369,800 | B2 * | 8/2019 | Rooney | B41J 2/17553 |
| 10,697,989 | B2 | 6/2020 | Horii | |
| 11,117,135 | B2 | 9/2021 | Horii et al. | |
| 2002/0001848 | A1 | 1/2002 | Bedingham et al. | |
| 2005/0093087 | A1 | 5/2005 | Kadel et al. | |
| 2006/0017790 | A1 * | 1/2006 | Jin | B41J 2/17523 347/86 |
| 2006/0185728 | A1 | 8/2006 | Delapierre | |
| 2006/0228256 | A1 | 10/2006 | McDevitt | |
| 2006/0245972 | A1 | 11/2006 | Osone et al. | |
| 2009/0074626 | A1 | 3/2009 | Kadel et al. | |
| 2010/0243078 | A1 | 9/2010 | Yoo | |
| 2011/0181672 | A1 | 7/2011 | Wagner et al. | |
| 2018/0117583 | A1 * | 5/2018 | Horii | B01L 9/527 |

FOREIGN PATENT DOCUMENTS

| | | | |
|---|---|---|---|
| EP | 3290928 | A1 | 3/2018 |
| EP | 3315198 | A1 | 5/2018 |
| EP | 3023335 | | 5/2022 |
| JP | 2005-096866 | A | 4/2005 |
| JP | 2011-047709 | | 3/2022 |

OTHER PUBLICATIONS

Communication pursuant to Article 94(3) EPC in European application No. 17197994.1, dated Mar. 29, 2019, 6 pages.
Communication pursuant to Article 94(3) EPC in Europe Application No. 17197994.1 dated Nov. 26, 2019, 4 pages.
Extended European Search Report in Europe Application No. 17197994.1, dated Feb. 22, 2018, 9 pages.
Office Action/Search Report in Japan Application No. 2016-211492, including English translation, dated Jun. 5, 2018, 5 pages.

* cited by examiner 800-800 CROSS-SECTION 801-801 CROSS-SECTION 802-802 CROSS-SECTION 803-803 CROSS-SECTION

LIQUID-SEALED CARTRIDGE AND LIQUID SENDING METHOD

RELATED APPLICATIONS

This application claims priority to Japanese Patent Application No. 2019-176472, filed on Sep. 27, 2019, the entire content of which is incorporated herein by reference.

BACKGROUND OF THE INVENTION

1. Field of the Invention

The present invention relates to a liquid-sealed cartridge in which liquid is sealed, and a liquid sending method for sending liquid in the liquid-sealed cartridge.

2. Description of the Related Art

Japanese Laid-Open Patent Publication No. 2005-96866 discloses a microstructure in which a first hollow chamber 902 and a second hollow chamber 903 that are separated from each other by a blocking element 901, a covering element 904 for covering the first hollow chamber 902, a take-out chamber 905, and a channel 906 for connecting between the second hollow chamber 903 and the take-out chamber 905, are formed, as shown in FIG. 31. The first hollow chamber 902 is filled with liquid.

In a case where a force is applied to the covering element 904, a first end portion 907 of the blocking element 901 is broken. A second end portion 908 of the blocking element 901 forms a pivotable hinge section. By the first end portion 907 of the blocking element 901 being broken, the liquid in the first hollow chamber 902 flows into the second hollow chamber 903. The liquid is transported by a capillary force to the channel 906 and the take-out chamber 905.

In the microstructure disclosed in Japanese Laid-Open Patent Publication No. 2005-96866, the blocking element 901 is pressed in the second hollow chamber 903 having a micro space, whereby the first end portion 907 of the blocking element 901 is broken to unseal the blocking element 901. In order to assuredly break the first end portion 907 of the blocking element 901, since the blocking element 901 is flexible, an indentation depth of a pressing member for pressing the blocking element 901 needs to be sufficiently great. However, the height of the second hollow chamber 903 having the micro space is low, so that the blocking element 901 is moved downward to an inner bottom surface of the second hollow chamber 903 and may come into contact with the inner bottom surface of the second hollow chamber 903 (see a broken line portion in FIG. 31).

In a case where the above-described blocking element 901 is moved downward to the inner bottom surface of the second hollow chamber 903 and the first end portion of the blocking element 901 comes into contact with the inner bottom surface of the second hollow chamber 903 (see the broken line portion in FIG. 31), even if a pressing force is applied, the blocking element 901 cannot be pushed any more. Therefore, a load on a device for applying the pressing force may increase or the inner bottom surface of the second hollow chamber 903 may be damaged.

SUMMARY OF THE INVENTION

The scope of the present invention is defined solely by the appended claims, and is not affected to any degree by the statements within this summary.

In order to attain the aforementioned object, a liquid-sealed cartridge (100) according to the present invention includes: a liquid storage portion (10) configured to store liquid (90); a flow path (20) in which the liquid (90) stored in the liquid storage portion (10) flows; and a liquid sealing portion (30) configured to seal the liquid (90) in the liquid storage portion (10). The liquid sealing portion (30) has an outer circumferential portion (33) and a center-side low strength portion (31) disposed closer to a center than the outer circumferential portion (33), and the center-side low strength portion (31) is broken when pressed, to allow the liquid (90) in the liquid storage portion (10) to flow in the flow path (20), as shown in FIG. 1.

In the description herein, the "low strength portion" represents a portion having a mechanical strength lower than that of a portion excluding the low strength portion in the liquid sealing portion. Particularly, "a mechanical strength is low" represents a property that breakage easily occurs by a pressing force.

In the liquid-sealed cartridge (100) according to the present invention, as described above, the liquid sealing portion (30) is broken so as to be parted into both side portions by the center-side low strength portion (31) of the liquid sealing portion (30) serving as a boundary when the liquid sealing portion (30) is pressed. Therefore, both end portions of the liquid sealing portion (30) serve as pivoting centers, respectively, and the radius (R) of each pivoting portion can thus be reduced. Thus, since the radius (R) of the pivoting portion can be reduced, pressing of the liquid sealing portion (30) can be ended before the liquid sealing portion (30) comes into contact with an inner bottom surface (61) of the liquid-sealed cartridge (100) or increase of a pressing force can be inhibited as compared with conventional art even in a case where the liquid sealing portion (30) comes into contact with the inner bottom surface (61). Consequently, a load on a pressing device can be reduced and damage to the inner bottom surface (61) of the liquid-sealed cartridge (100) can be inhibited.

A liquid sending method according to the present invention is directed to a liquid sending method for a liquid-sealed cartridge (100) including a liquid storage portion (10) for storing liquid (90), and a liquid sealing portion (30) for sealing the liquid storage portion (10), and the liquid sending method includes: pressing a center-side low strength portion (31) of the liquid sealing portion (30) and breaking the liquid sealing portion (30) at the center-side low strength portion (31) serving as a boundary; and causing the liquid (90) to flow from the liquid storage portion (10) for which the center-side low strength portion (31) has been broken, as shown in FIG. 1.

In the liquid sending method according to the present invention, similarly to the above-described invention, the liquid sealing portion (30) can be broken, when pressed, so as to be parted into both side portions by the center-side low strength portion (31) of the liquid sealing portion (30) serving as a boundary. As a result, the radius (R) of the pivoting portion of the liquid sealing portion (30) in pressing can be reduced. Thus, since the radius (R) of the pivoting portion can be reduced, pressing of the liquid sealing portion (30) can be ended before the liquid sealing portion (30) comes into contact with an inner bottom surface (61) of the liquid-sealed cartridge (100) or increase of a pressing force can be inhibited as compared with conventional art even in a case where the liquid sealing portion (30) comes into contact with the inner bottom surface (61). Consequently, a load on a pressing device can be reduced, and damage to the inner bottom surface (61) of the liquid-sealed cartridge (100) can be inhibited.

According to the present invention, a load on a pressing device can be reduced, and damage to the inner bottom surface of the liquid-sealed cartridge can be inhibited.

DETAILED DESCRIPTION OF THE PREFERRED EMBODIMENTS

Figure 1A:
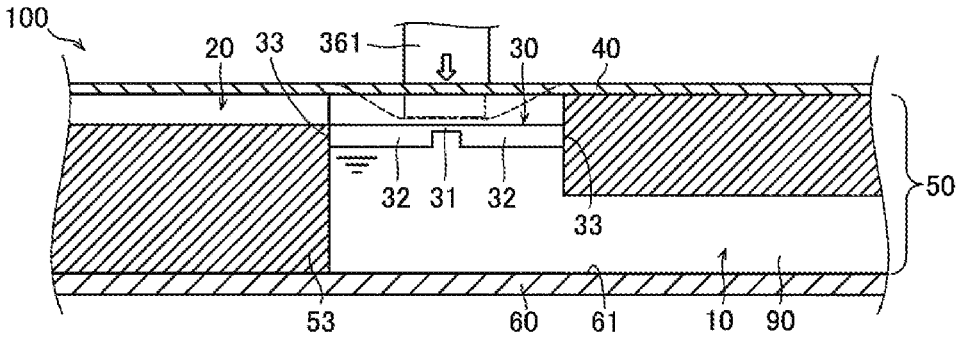
FIG. 1A is a schematic diagram illustrating a liquid-sealed cartridge which has not been unsealed.

Hereinafter, embodiments will be described with reference to the drawings.

(Outline of Liquid-Sealed Cartridge)

A liquid-sealed cartridge 100 of the present embodiment will be described with reference to FIG. 1.

The liquid-sealed cartridge 100 is a container having a space in which a liquid 90 can be stored. The liquid-sealed cartridge 100 can seal the liquid 90 stored thereinside. The liquid-sealed cartridge 100 can release the sealing of the liquid 90 stored thereinside, through an operation from the outside of the cartridge. By releasing the sealing, the liquid 90 in the liquid-sealed cartridge 100 can be transferred to another portion in the cartridge or to the outside of the cartridge.

The outer shape of the liquid-sealed cartridge 100 is not particularly limited. The liquid-sealed cartridge 100 has, for example, a plate-like shape.

The liquid-sealed cartridge 100 includes at least one liquid storage portion 10, at least one flow path 20, and at least one liquid sealing portion 30.

The liquid storage portion 10 is configured to store the liquid 90. That is, the liquid storage portion 10 is a space having a volume which allows a predetermined amount of the liquid 90 to be stored. The liquid storage portion 10 is defined by an inner upper surface, an inner bottom surface, and inner side surfaces. The liquid 90 is stored beforehand in the liquid storage portion 10. The liquid storage portion 10 may be empty when the liquid-sealed cartridge 100 is manufactured, and a user of the liquid-sealed cartridge 100 may fill the liquid storage portion 10 with the liquid 90.

The flow path 20 is configured to allow the liquid 90 stored in the liquid storage portion 10 to flow. The flow path 20 is a hollow tubular element through which the liquid 90 can flow. The flow path 20 communicates with the liquid storage portion 10 in a state where at least the liquid-sealed cartridge 100 has been unsealed. Before the liquid-sealed cartridge 100 is unsealed, the flow path 20 is defined by the liquid sealing portion 30 so as not to communicate with the liquid storage portion 10. The flow path 20 includes, for example, a first end connecting to the liquid storage portion 10 through the liquid sealing portion 30, and a second end connecting to a space into which the liquid 90 is to be transferred or to the outside of the liquid-sealed cartridge 100.

The liquid sealing portion 30 is configured to seal the liquid 90 in the liquid storage portion 10. The liquid sealing portion 30 prevents the liquid 90 from flowing from the liquid storage portion 10 into the flow path 20. For example, the liquid sealing portion 30 is disposed so as to disconnect the liquid storage portion 10 and the flow path 20 from each other at a connecting portion between the liquid storage portion 10 and the flow path 20. One liquid sealing portion 30 or a plurality of the liquid sealing portions 30 are disposed for one liquid storage portion 10.

The liquid sealing portion 30 is configured to be irreversibly unsealed. Specifically, the liquid sealing portion 30 is pressed and a part of the liquid sealing portion 30 is broken by the pressing force. The liquid sealing portion 30 is unsealed by breaking the liquid sealing portion 30. For example, the liquid 90 can flow through a portion at which the liquid sealing portion 30 is broken. In the description herein, a state where a part of the liquid sealing portion 30 is broken to allow the liquid 90 in the liquid storage portion 10 to flow is referred to as "unsealed".

The liquid-sealed cartridge 100 has a body portion 50 in which the liquid storage portion 10, the flow path 20, and the liquid sealing portion 30 are formed. The body portion 50 is formed of, for example, a resin material. For example, COP (cycloolefin polymer) can be used as the resin material. The liquid storage portion 10 and the flow path 20 are formed as recesses, grooves, or the like formed in the body portion 50. The liquid storage portion 10 and the flow path 20 can be structured as internal spaces of the liquid-sealed cartridge 100 by covering the recesses, grooves, or the like formed in the body portion 50 with a base film 60. The base film 60 is formed of, for example, a resin material. For example, COP (cycloolefin polymer) can be used as the resin material. The base film 60 forms an inner bottom surface 61 of the liquid storage portion 10. The liquid sealing portion 30 has an outer circumferential portion 33 supported by the body portion 50.

In the example shown in FIG. 1, the liquid-sealed cartridge 100 further includes a cover portion 40 opposing the liquid sealing portion 30. The cover portion 40 is disposed so as to cover the liquid sealing portion 30. The cover portion 40 prevents the liquid 90 from flowing to the outside of the liquid-sealed cartridge 100 when the liquid sealing portion 30 has been unsealed. When the liquid sealing portion 30 is unsealed, an external force is applied from the outside of the liquid-sealed cartridge 100 through the cover portion 40 to the liquid sealing portion 30. Therefore, the cover portion 40 is configured to be deformable by the external force such that a pressing member 361 can press the liquid sealing portion 30 through the cover portion 40. The cover portion 40 is, for example, a film-like member, and is formed of an elastically deformable material such as elastomer or rubber. The cover portion 40 is, for example, a film formed of polyurethane elastomer. In a case where the body portion 50 is elastically deformable, the liquid sealing portion 30 can be pressed from the outside of the liquid-sealed cartridge 100 through the body portion 50. Therefore, the cover portion 40 need not be separately provided.

In order to unseal the liquid sealing portion 30, a pressing force is applied to the liquid sealing portion 30 from the outside of the liquid-sealed cartridge 100 by the pressing member 361. At this time, the pressing member 361 firstly presses the cover portion 40 toward the liquid sealing portion 30 to elastically deform the cover portion 40. The pressing member 361 comes into contact with the liquid sealing portion 30 through the cover portion 40. The pressing member 361 is moved so as to push the liquid sealing portion 30 and breaks the liquid sealing portion 30, thereby unsealing the liquid sealing portion 30. The pressing member 361 has, for example, a bar-like shape, and is moved by a pressing device. The pressing device has a driving source such as a motor, a voice coil, a spring, or an accumulator for moving the pressing member 361.

In the present embodiment, the liquid sealing portion 30 includes the outer circumferential portion 33 and a center-side low strength portion 31 disposed closer to the center than the outer circumferential portion 33. When the liquid sealing portion 30 is pressed, the center-side low strength portion 31 is broken to allow the liquid 90 in the liquid storage portion 10 to flow into the flow path 20.

Specifically, the liquid sealing portion 30 includes the center-side low strength portion 31 and a base body portion 32 that is a portion other than the low strength portion. The center-side low strength portion 31 has a mechanical strength that is lower than that of the base body portion 32. That is, the center-side low strength portion 31 is broken more easily than the base body portion 32 in a case where a pressing force is applied to the liquid sealing portion 30 for unsealing. An external force required for breaking the center-side low strength portion 31 is lower than an external force required for breaking the base body portion 32.

The center-side low strength portion 31 has a thickness less than the base body portion 32, as shown in, for example, FIG. 1. In addition thereto, for example, the center-side low strength portion 31 is formed of a material having a mechanical strength lower than a material forming the base body portion 32. For example, the center-side low strength portion 31 is configured to have a density less than the base body portion 32 by, for example, a hollow inside being formed in the center-side low strength portion 31.

Figure 1B:
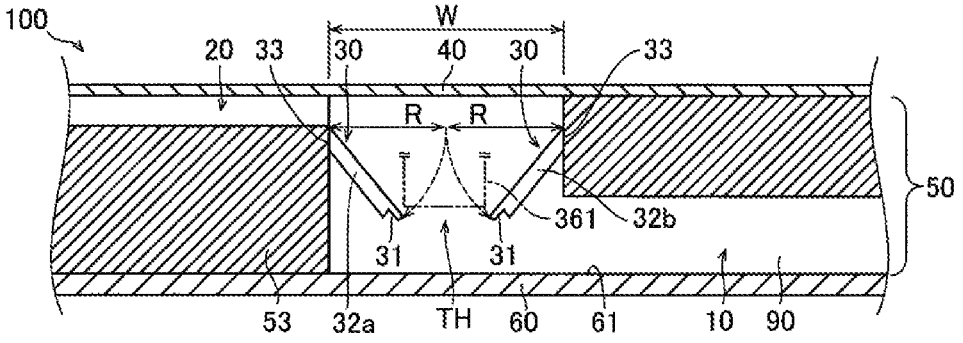
FIG. 1B is a schematic diagram illustrating the liquid-sealed cartridge which is being unsealed.

The center-side low strength portion 31 is disposed closer to the center than the outer circumferential portion 33 of the liquid sealing portion 30. The base body portion 32 is disposed on both sides of the center-side low strength portion 31. That is, the base body portion 32 is disposed between the center-side low strength portion 31 and the outer circumferential portion 33. Therefore, by pressing the liquid sealing portion 30 through the cover portion 40 as shown in FIG. 1A, the center-side low strength portion 31 is broken as shown in FIG. 1B. By the center-side low strength portion 31 being broken, the liquid sealing portion 30 is parted by the center-side low strength portion 31 on the center side serving as a boundary. That is, the center-side end portions of the base body portion 32 on both sides of the center-side low strength portion 31 are separated from each other. The base body portions 32 on both sides of the center-side low strength portion 31 are pushed and spread so as to separate from each other like a double-door by the pressing force.

Figure 1C:
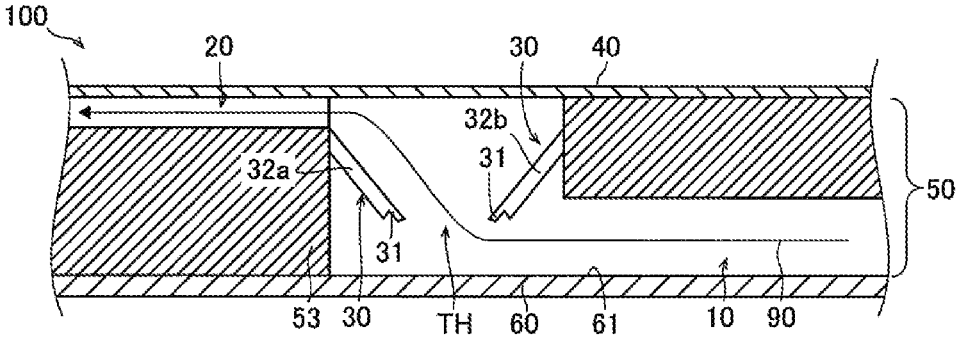
FIG. 1C is a schematic diagram illustrating the liquid-sealed cartridge which has been unsealed.

As shown in FIG. 1C, after the pressing force has been applied, a through hole TH that allows the liquid storage portion 10 to communicate with the outside of the liquid storage portion 10 is formed in the liquid sealing portion 30. By forming the through hole TH, the liquid sealing portion 30 is unsealed. Thus, the liquid sealing portion 30 is configured to allow the liquid 90 in the liquid storage portion 10 to flow into the flow path 20 by breaking the center-side low strength portion 31.

Figure 31:
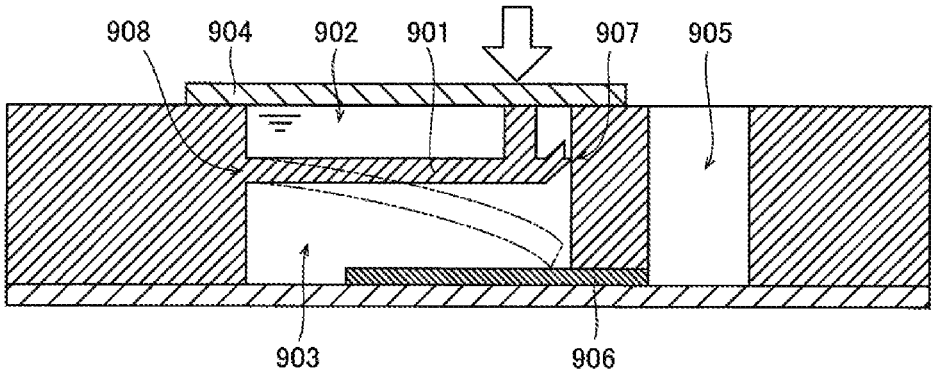
FIG. 31 illustrates conventional art.

The base body portion 32 on both sides of the center-side low strength portion 31 is pushed and spread by the pressing member 361 at the center-side low strength portion 31 serving as the boundary. The base body portion 32 on each of both the sides pivots around the outer circumferential portion 33 of the liquid sealing portion 30. Therefore, a pivoting radius R of the base body portion 32 is about half the entire width W of the liquid sealing portion 30. Therefore, the indentation depth, of the pressing member 361, required for unsealing the liquid sealing portion 30 is less than that for a case where the entirety of the liquid sealing portion 30 having the entire width W pivots around one of the end portions of the liquid sealing portion 30 (that is, a case where the pivoting radius is the entire width W, see FIG. 31).

(Effect of Liquid-Sealed Cartridge)

In the liquid-sealed cartridge 100 of the present embodiment, as described above, by pressing the liquid sealing portion 30, the liquid sealing portion 30 is broken so as to be parted into both side portions at the center-side low strength portion 31 serving as the boundary. Therefore, both end portions of the liquid sealing portion 30 each serve as a pivoting center to reduce the radius R of the pivoting portion. Thus, since the radius R of the pivoting portion can be reduced, pressing of the liquid sealing portion 30 can be ended before the liquid sealing portion 30 comes into contact with the inner bottom surface 61 of the liquid-sealed cartridge 100, or increase of pressing force can be inhibited as compared with conventional art even if the liquid sealing portion 30 comes into contact with the inner bottom surface. Consequently, a load on a pressing device can be reduced, and damage to the inner bottom surface of the liquid-sealed cartridge 100 can be inhibited.

Furthermore, in a structure in which the cover portion 40 opposing the liquid sealing portion 30 is disposed, the liquid sealing portion 30 is pressed through the cover portion 40 while the liquid sealing portion 30 is covered with the cover portion 40, thereby unsealing the liquid sealing portion 30 without causing leakage of liquid. In this case, increase of an indentation depth for pressing may cause damage to the cover portion 40. However, in the present embodiment, the indentation depth for pressing can be reduced, so that damage to not only the inner bottom surface 61 but also the cover portion 40 can be inhibited.

(Additional Structure of Liquid-Sealed Cartridge)

In the example shown in FIG. 1, the liquid sealing portion 30 includes one side portion 32*a* adjacent to one side of the center-side low strength portion 31 and the other side portion 32*b* adjacent to the other side of the center-side low strength portion 31 as viewed in the pressing direction. The one side portion 32*a* and the other side portion 32*b* are each a part of the base body portion 32.

As shown in FIG. 1B and FIG. 1C, the one side portion 32*a* and the other side portion 32*b* are each configured to continuously extend from the outer circumferential portion 33 to the center-side low strength portion 31 in the liquid sealing portion 30 and to be deformed in the pressing direction when pressed. Each of the one side portion 32*a* and the other side portion 32*b* is not fully broken at the outer circumferential portion 33 and is plastically deformed so as to pivot around the outer circumferential portion 33.

Thus, even when the center-side low strength portion 31 has been broken, each of one side portion 32*a* and the other side portion 32*b* is maintained so as to connect to the outer circumferential portion 33 of the liquid sealing portion 30. If the broken portion is separated from the liquid sealing portion 30, the separated portion falls onto the liquid storage portion 10 or the flow path 20, and liquid sending may be hindered depending on a position onto which the separated portion has fallen. Meanwhile, the one side portion 32*a* and the other side portion 32*b* can be inhibited from separating from the liquid sealing portion 30. In the liquid-sealed cartridge 100 of the present embodiment, as long as the one side portion 32*a* and the other side portion 32*b* are not fully separated, the one side portion 32*a* and the other side portion 32*b* may be partially broken.

In the example shown in FIG. 1B, the center-side low strength portion 31 is pressed and thus broken, and is held by at least one of the one side portion 32*a* and the other side portion 32*b*. Thus, not only the one side portion 32*a* and the other side portion 32*b* but also the center-side low strength portion 31 can be prevented from being separated from the liquid sealing portion 30 due to the breakage.

(Liquid Sending Method)

Next, a liquid sending method of the present embodiment will be described. The liquid sending method of the present embodiment is a liquid sending method for the liquid-sealed cartridge 100 that includes the liquid storage portion 10 for storing the liquid 90, and the liquid sealing portion 30 for sealing the liquid storage portion 10.

Figure 2:
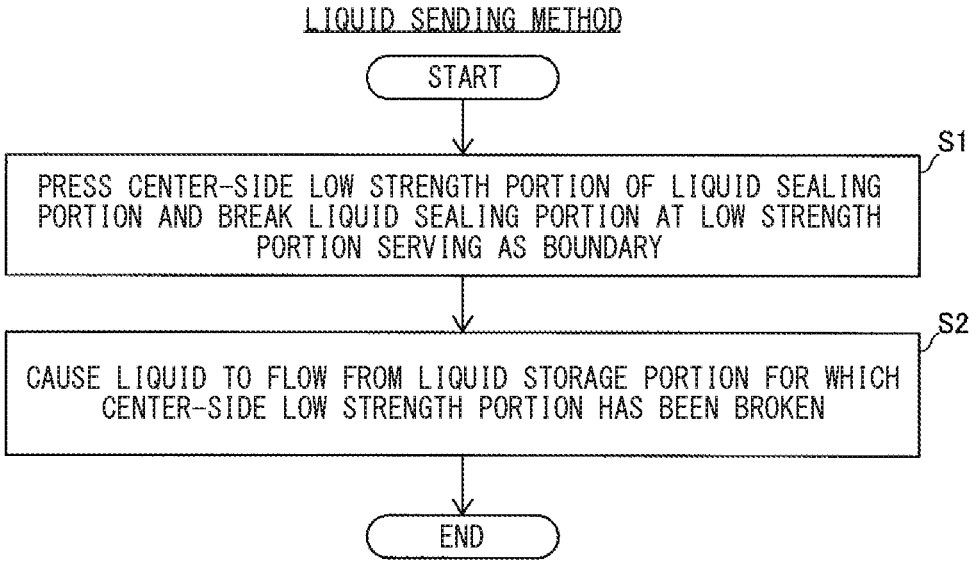
FIG. 2 is a flow chart showing a liquid sending method.

As shown in FIG. 2, the liquid sending method of the present embodiment includes at least steps of S1 and S2 as described below. (S1) The center-side low strength portion 31 of the liquid sealing portion 30 is pressed to break the liquid sealing portion 30 at the center-side low strength portion 31 serving as a boundary. (S2) The liquid 90 is caused to flow from the liquid storage portion 10 for which the center-side low strength portion 31 has been broken.

In step S1, the pressing member 361 is moved to press the center-side low strength portion 31 of the liquid sealing portion 30. By pressing the center-side low strength portion 31, the center-side low strength portion 31 is broken. The liquid sealing portion 30 is parted and broken at the center-side low strength portion 31 serving as the boundary. Therefore, the base body portions 32 on both sides of the center-side low strength portion 31 separate from each other to form the through hole TH at the broken portion. The base body portions 32 on both sides of the center-side low strength portion 31 are pushed and spread so as to separate from each other like a double-door by the pressing force. Step S1 has been described above in detail for the liquid-sealed cartridge 100 with reference to FIG. 1.

In step S2, an external force is applied to the liquid 90 in the liquid storage portion 10 to allow the liquid 90 to flow from the liquid storage portion 10 for which the center-side low strength portion 31 has been broken. The external force to be applied to the liquid 90 is not particularly limited. The external force to be applied to the liquid 90 may be, for example, gravity, pressure, centrifugal force, or the like. Gravity allows the liquid 90 to flow from the liquid storage portion 10 to a position lower in height than the liquid storage portion 10 in the liquid-sealed cartridge 100 or flow from the liquid storage portion 10 to the outside of the liquid-sealed cartridge 100. For example, by applying air pressure or water pressure to the liquid-sealed cartridge 100 from an external pressure source, the liquid 90 can flow from the liquid storage portion 10 to any position.

Figure 3:
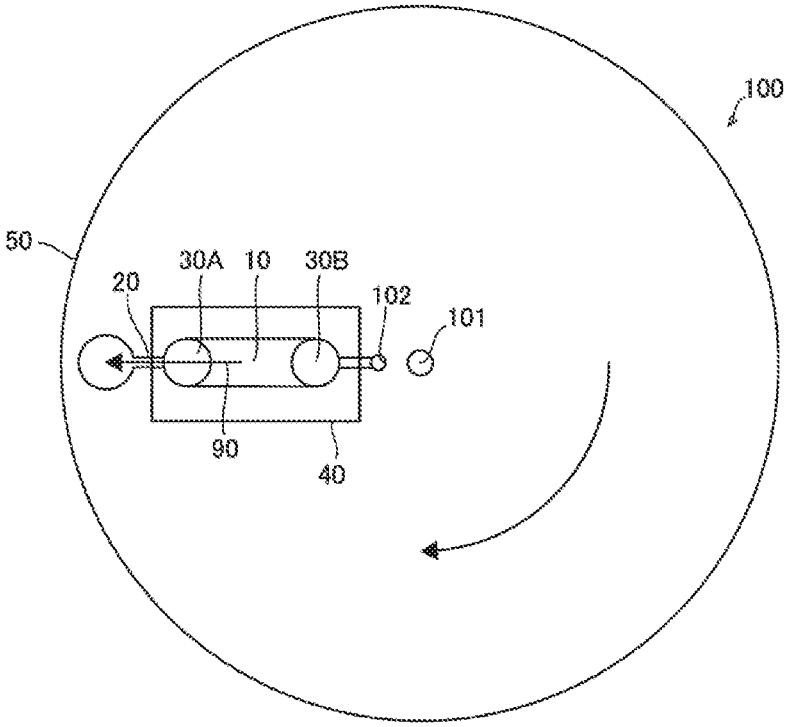
FIG. 3 illustrates an example of the liquid-sealed cartridge in the case of liquid being sent by a centrifugal force.

In the example shown in FIG. 3, the liquid storage portion 10 is disposed closer to the center of the liquid-sealed cartridge 100 than the flow path 20. In step S2 of causing the liquid 90 to flow, the liquid-sealed cartridge 100 is rotated so as to allow the liquid 90 in the liquid storage portion 10 to flow into the flow path 20 through the center-side low strength portion 31 having been pressed (see FIG. 1).

That is, after the unsealing in step S1, the liquid-sealed cartridge 100 is rotated around a center shaft 101, to apply a centrifugal force to the liquid 90 in the liquid storage portion 10. Thus, the liquid 90 moves from the liquid storage portion 10 toward the flow path 20 on the outer circumferential side.

(Effect of Liquid Sending Method)

In the liquid sending method of the present embodiment, as described above, the liquid sealing portion 30 can be pressed and thus broken so as to be parted into both side portions by the center-side low strength portion 31 of the liquid sealing portion 30 serving as a boundary. As a result, the radius of the pivoting portion of the liquid sealing portion 30 in the pressing can be reduced. Thus, since the radius of the pivoting portion can be reduced, pressing of the liquid sealing portion 30 can be ended before the liquid sealing portion 30 comes into contact with the inner bottom surface 61 of the liquid-sealed cartridge 100 or increase of a pressing force can be inhibited as compared with conventional art even if the liquid sealing portion 30 comes into contact with the inner bottom surface 61. Consequently, a load on a pressing device can be reduced, and damage to the inner bottom surface 61 of the liquid-sealed cartridge 100 can be inhibited.

Furthermore, in the configuration shown in FIG. 3 in which liquid is sent by rotation, the liquid 90 can be sent merely by rotating the liquid-sealed cartridge 100.

(Example of Configuration of Liquid-Sealed Cartridge)

In the example shown in FIG. 3, the liquid-sealed cartridge 100 includes the disk-shaped body portion 50 in which the liquid storage portion 10, the flow path 20, and the liquid sealing portion 30 are formed. The liquid storage portion 10 is disposed closer to the center of the body portion 50 than the flow path 20. The liquid-sealed cartridge 100 is configured to allow the liquid 90 in the liquid storage portion 10 to flow into the flow path 20 by rotating the body portion 50. Thus, the liquid 90 can be sent merely by rotating the liquid-sealed cartridge 100.

In the liquid storage portion 10, a liquid sealing portion 30A on the radially outer side and a liquid sealing portion 30B on the radially inner side are disposed. The liquid sealing portion 30B on the radially inner side connects with an air hole 102. The liquid sealing portion 30A on the radially outer side connects with the flow path 20. When, by unsealing the liquid sealing portions 30A and 30B, the liquid 90 in the liquid storage portion 10 flows into the flow path 20 during liquid sending, air flows into the liquid storage portion 10 through the air hole 102. As a result, negative pressure is generated inside the liquid storage portion 10 and prevention of movement of the liquid 90 can be avoided.

Furthermore, the liquid sealing portion 30 is integrated with the liquid storage portion 10. Thus, as compared with a case where the liquid sealing portion 30 and the liquid storage portion 10 are provided as separate components, the number of components of the liquid-sealed cartridge 100 can be reduced. Furthermore, no gap is formed between components, so that the liquid 90 can be assuredly sealed.

(Example of Configuration of Liquid Sealing Portion)

Next, an example of a configuration of the liquid sealing portion 30 will be described with reference to FIG. 4 to FIG. 18.

<Planar Shape and Disposition of Low Strength Portion>

Firstly, examples of the shape and the disposition of the low strength portion in a planar view of the surface of the liquid sealing portion 30 will be described. In FIG. 4 and FIG. 5, for convenience sake, the low strength portion is hatched, and the base body portion 32, and the one side portion 32*a* and the other side portion 32*b* each of which is a part of the base body portion 32 are not hatched.

In the examples shown in FIG. 4A to FIG. 4F, the center-side low strength portion 31 is disposed at a center portion 34 of the liquid sealing portion 30. Thus, the liquid sealing portion 30 is broken so as to separate into two portions on both sides at the center portion 34 serving as the boundary. Therefore, the radiuses of the pivoting portions that pivot around both end portions of the liquid sealing portion 30 can be made uniform and minimized. The center portion 34 may not necessarily be disposed at the center of the liquid sealing portion 30, and the position of the center portion 34 is not particularly limited as long as the center portion 34 is disposed closer to the center than the outer circumferential portion 33.

The base body portion 32 is formed around the center-side low strength portion 31. The center-side low strength portion 31 is preferably shaped so as to have directivity in a specific direction instead of being shaped into an isotropic shape such as a perfect circle such that the center-side low strength portion 31 can be broken to form the one side portion 32*a* and the other side portion 32*b* on both sides by the center-side low strength portion 31 serving as the boundary.

In the examples shown in FIG. 4A to FIG. 4F, the center-side low strength portion 31 has at least one of a liner, a rectangular, a cross-like, and an ellipsoidal planar shape as viewed in the pressing direction. Thus, the center-side low strength portion 31 is broken so as to be torn in a predetermined direction, thereby easily controlling the breaking direction of the center-side low strength portion 31. As a result, the center-side low strength portion 31 can be inhibited from being broken in an unintended direction during unsealing, and variation in the shape of the through hole TH formed by the breakage can be reduced.

Figure 4A:
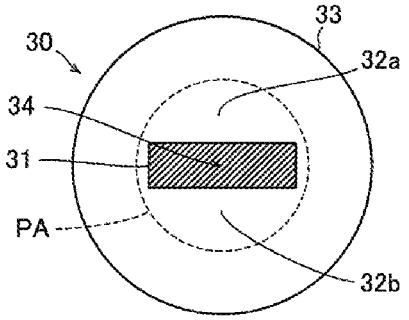
FIG. 4A illustrates an example of a configuration of a liquid sealing portion.

In FIG. 4A, the center-side low strength portion 31 has a linear or rectangular shape. A pressed region PA is pressed by the pressing member 361. The pressed region PA is a region on which a pressing force from the pressing member 361 directly acts, and which comes into contact with the pressing member 361 through the cover portion 40 when pressed. At least a part of the center-side low strength portion 31 is in the pressed region PA. The through hole TH is formed so as to separate the one side portion 32*a* and the other side portion 32*b* from each other by the pressing force at the center-side low strength portion 31 serving as the boundary.

Figure 4B:
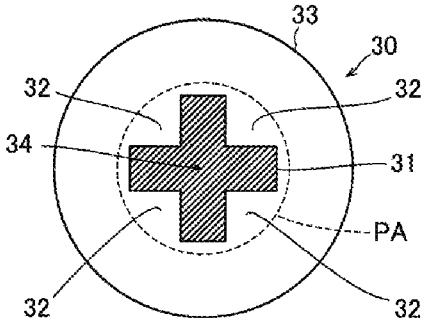
FIG. 4B illustrates an example of a configuration of the liquid sealing portion.

In FIG. 4B, the center-side low strength portion 31 is cross-shaped. When the pressed region PA is pressed, the cross-shaped center-side low strength portion 31 is broken so as to be torn in the length direction or the lateral direction in FIG. 4B. Alternatively, the center-side low strength portion 31 is broken so as to be torn in a cross-like shape. In a case where the center-side low strength portion 31 is broken so as to be torn in a cross-like shape, the through hole TH is formed so as to separate the base body portion 32 at the four corners of the cross-shape into four separate segments.

Figure 4C:
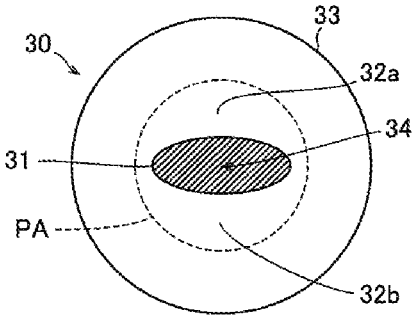
FIG. 4C illustrates an example of a configuration of the liquid sealing portion.
Figure 4D:
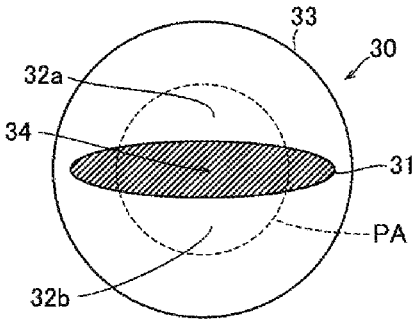
FIG. 4D illustrates an example of a configuration of the liquid sealing portion.

In FIG. 4C, the center-side low strength portion 31 has an ellipsoidal shape. In this case, as in FIG. 4A, the through hole TH is formed so as to separate the one side portion 32*a* and the other side portion 32*b* from each other at the center-side low strength portion 31 serving as the boundary.

In FIGS. 4A to 4C, the center-side low strength portion 31 is in the pressed region PA. Meanwhile, in FIG. 4D, the center-side low strength portion 31 is formed so as to extend to a portion outside the pressed region PA from the center portion 34 of the liquid sealing portion 30. The center-side low strength portion 31 extends to a portion near the outer circumferential portion 33. Thus, the through hole TH can be increased, so that an amount of the liquid 90 that remains due to the unsealed liquid sealing portion 30 becoming an obstacle can be reduced when the liquid 90 is transferred. Furthermore, the greater the center-side low strength portion 31 is, the lower a pressing force for unsealing is. Therefore, a load on a pressing device can be effectively reduced.

Figure 4E:
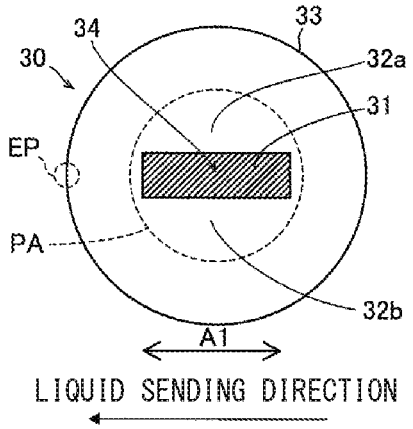
FIG. 4E illustrates an example of a configuration of the liquid sealing portion.

In FIG. 4E, the center-side low strength portion 31 extends in a first direction A1 at the center portion 34 of the liquid sealing portion 30. The first direction A1 is along a direction in which the liquid 90 is sent through the liquid sealing portion 30.

Thus, the center-side low strength portion 31 is broken along the liquid sending direction. Therefore, the through hole TH can be formed so as to extend to a position near an end portion EP of the liquid sealing portion 30 in the liquid sending direction. Therefore, in a case where liquid is accumulated by a wall formed by the liquid sealing portion 30 having been unsealed, an amount of the accumulated liquid can be reduced by the through hole TH that is formed so as to extend to a position near the end portion EP. That is, an amount of the liquid 90 that remains due to the liquid sealing portion 30 can be preferably reduced when the liquid is sent.

Figure 4F:
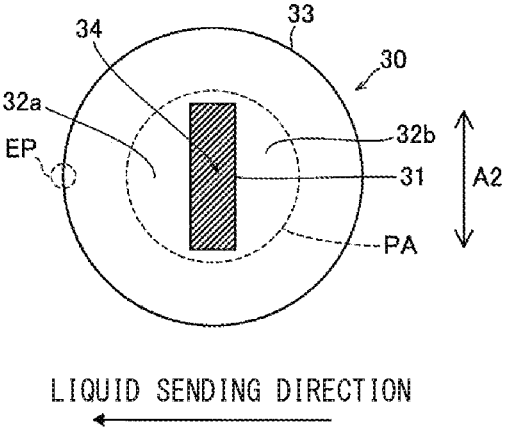
FIG. 4F illustrates an example of a configuration of the liquid sealing portion.

As shown in FIG. 4F, a first direction A2 of the center-side low strength portion 31 may be different from the liquid sending direction.

Figure 5A:
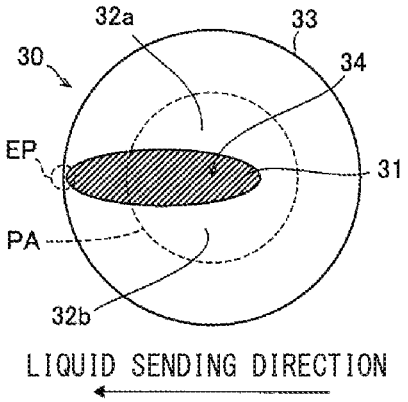
FIG. 5A illustrates an example of another configuration of the liquid sealing portion.

As shown in FIG. 5A, the center of the center-side low strength portion 31 may be formed on the outer circumferential portion 33 side in the liquid sealing portion 30 so as to deviate from the center portion 34 of the liquid sealing portion 30. In FIG. 5A, the center-side low strength portion 31 is eccentrically formed on the end portion EP side in the liquid sending direction in the liquid sealing portion 30. In this case, as in FIG. 4E, an amount of the liquid 90 that remains when the liquid is sent can be preferably reduced.

Figure 5B:
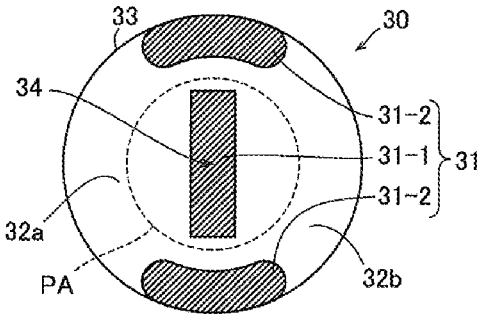
FIG. 5B illustrates an example of another configuration of the liquid sealing portion.

As shown in FIG. 5B, the liquid sealing portion 30 may include a center-side low strength portion 31-1, and outer-circumferential-side low strength portions 31-2 which are formed in the outer circumferential portion 33 and are different from the center-side low strength portion 31-1. In FIG. 5B, the liquid sealing portion 30 includes the center-side low strength portion 31-1 and the outer-circumferential-side low strength portions 31-2.

When the liquid sealing portion 30 has been pressed, the center-side low strength portion 31-1 and the outer-circumferential-side low strength portions 31-2 are broken. Since a width of the base body portion 32 between the center-side low strength portion 31-1 and each outer-circumferential-side low strength portion 31-2 is narrow, the base body portion 32 is easily broken. Thus, the through hole TH of the center-side low strength portion 31-1 and the through hole TH of each outer-circumferential-side low strength portion 31-2 connect to each other during unsealing, to form a large through hole TH that extends from the center portion 34 to the outer circumferential portion 33 in the liquid sealing portion 30 along the liquid sending direction. Therefore, an amount of the liquid 90 that remains due to the liquid sealing portion 30 having been unsealed, can be reduced.

Before the breakage, the center-side low strength portion 31-1 and each outer-circumferential-side low strength portion 31-2 are separate from each other and the base body portion 32 is disposed therebetween. Therefore, a mechanical strength can be assured in a case where the center-side low strength portion 31-1 and the outer-circumferential-side low strength portions 31-2 are not directly pressed. Therefore, unintended unsealing due to, for example, an impact from the outside can be inhibited.

Figure 5C:
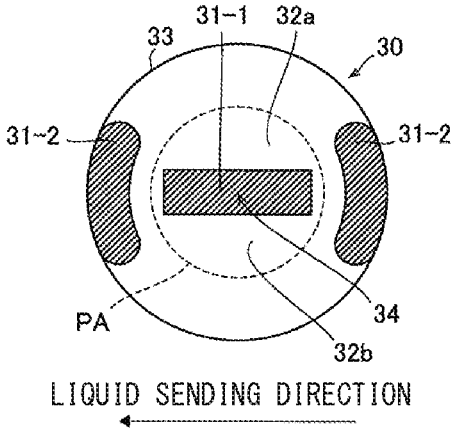
FIG. 5C illustrates an example of another configuration of the liquid sealing portion.

In the example shown in FIG. 5C, the center-side low strength portion 31-1 and the outer-circumferential-side low strength portions 31-2 are formed so as to be aligned along the liquid sending direction. In this case, the through hole TH of the center-side low strength portion 31-1 and the through hole TH of each outer-circumferential-side low strength portion 31-2 connect to each other during unsealing, to form a large through hole TH that extends from the center portion 34 to the outer circumferential portion 33 in the liquid sealing portion 30 along the liquid sending direction. Therefore, an amount of the liquid 90 that remains due to the liquid sealing portion 30 having been unsealed can be reduced.

Figure 5D:
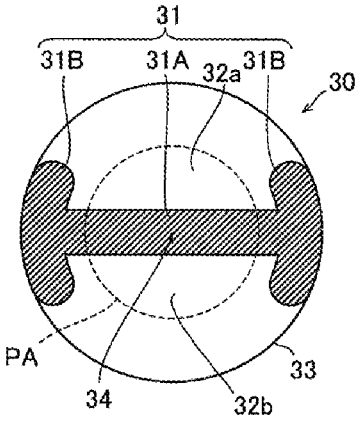
FIG. 5D illustrates an example of another configuration of the liquid sealing portion.

In the example shown in FIG. 5D, the center-side low strength portion 31 continuously extends from the center portion 34 to the outer circumferential portion 33 in the liquid sealing portion 30. That is, one center-side low strength portion 31 integrally includes a first portion 31A disposed at the center portion 34 and second portions 31B disposed along the outer circumferential portion 33 of the liquid sealing portion 30. Also in this case, a large through hole TH is formed to reduce an amount of the remaining liquid 90. Furthermore, the center-side low strength portion 31 continuously extends from one end of the liquid sealing portion 30 to the other end thereof. Therefore, unsealing can be easily performed with a low pressing force.

Figure 5E:
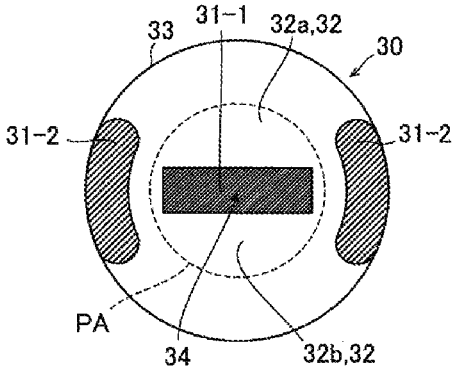
FIG. 5E illustrates an example of another configuration of the liquid sealing portion.

The low strength portion may include a portion having a relatively high strength and a portion having a relatively low strength. In the example shown in FIG. 5E, the center-side low strength portion 31-1 has a strength lower than that of each outer-circumferential-side low strength portion 31-2. For example, the thickness of the center-side low strength portion 31-1 is less than the thickness of the outer-circumferential-side low strength portion 31-2. In FIG. 5E, different strengths are represented by different hatchings. The center-side low strength portion 31-1 and the outer-circumferential-side low strength portions 31-2 each have a strength lower than that of the base body portion 32.

By providing such a distribution in strength, the order of the breakage can be controlled. As a result, for example, even in a case where a position at which the center-side low strength portion 31-1 is pressed deviates due to, for example, a mechanical error or a dimension error of the liquid-sealed cartridge 100, the shape of the through hole TH to be formed can be inhibited from varying.

(First Specific Configuration Example of Liquid Sealing Portion)

FIG. 6 to FIG. 10 illustrate one of specific configuration examples of the liquid sealing portion 30.

Figure 6:
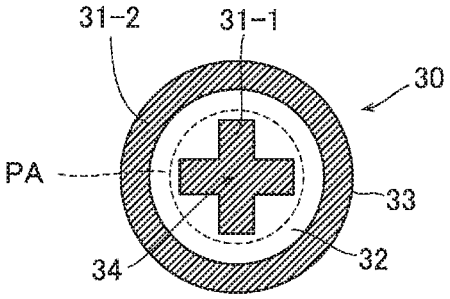
FIG. 6 is a schematic diagram illustrating a first specific configuration example of the liquid sealing portion.

In the first specific configuration example shown in FIG. 6, the liquid sealing portion 30 has a circular planar shape. The center-side low strength portion 31-1 is formed to be cross-shaped in the center portion 34 of the liquid sealing portion 30. The outer-circumferential-side low strength portion 31-2 is formed in the outer circumferential portion 33 of the liquid sealing portion 30. The outer-circumferential-side low strength portion 31-2 is formed in an annular shape so as to surround the center portion 34. The base body portion 32 is formed inside the outer-circumferential-side low strength portion 31-2 so as to surround the center-side low strength portion 31-1. That is, a portion between the center-side low strength portion 31-1 and the outer-circumferential-side low strength portion 31-2 is the base body portion 32.

Figure 9:
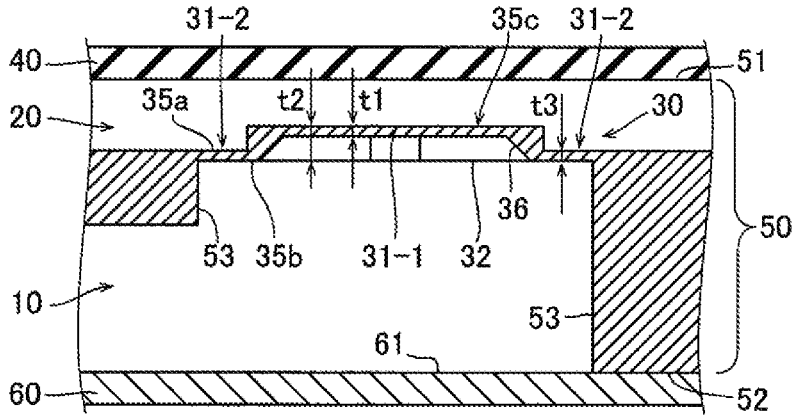
FIG. 9 is a cross-sectional view taken along a line 800-800 in FIG. 7A.
Figure 10:
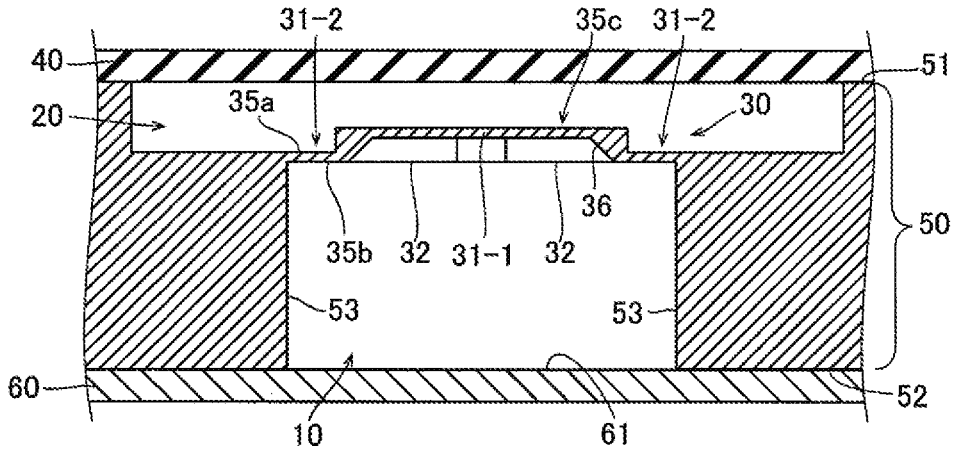
FIG. 10 is a cross-sectional view taken along a line 801-801 in FIG. 7A.

As shown in FIG. 9 and FIG. 10, the liquid sealing portion 30 forms a part of the bottom surface of the flow path 20. The upper face opening of the flow path 20 is covered by the cover portion 40 disposed on one surface 51 of the body portion 50.

Figure 7A:
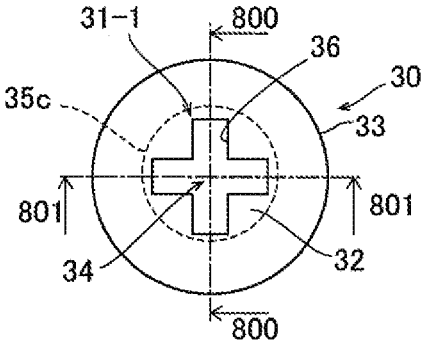
FIG. 7A is a plan view of the liquid sealing portion shown in FIG. 6 as viewed from the back surface side.
Figure 7B:
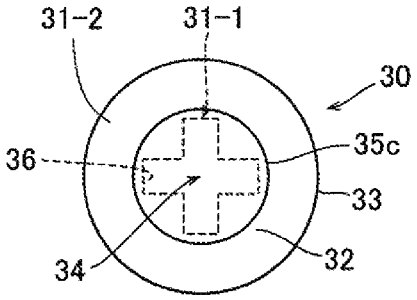
FIG. 7B is a plan view of the liquid sealing portion shown in FIG. 6 as viewed from a pressure-receiving face side.
Figure 8:
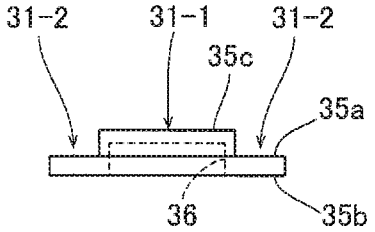
FIG. 8 is a schematic side view of the liquid sealing portion shown in FIG. 6.

As shown in FIG. 7B and FIG. 8, the liquid sealing portion 30 has a pressure-receiving face 35*a* to be pressed through the cover portion 40 (see FIG. 9, FIG. 10). The pressure-receiving face 35*a* is a surface on the cover portion 40 side of the liquid sealing portion 30. The liquid sealing portion 30 includes a projection 35*c* to be pressed by the pressing member 361. The projection 35*c* projects toward the cover portion 40. The projection 35*c* is formed at the center portion 34 of the liquid sealing portion 30. In the pressure-receiving face 35*a*, a portion in which the projection 35*c* is formed is the pressed region PA of the liquid sealing portion 30. Since the projection 35*c* projects toward the cover portion 40, the pressing member 361 can press the liquid sealing portion 30 through the cover portion 40 with a reduced indentation depth.

As shown in FIG. 9 and FIG. 10, the liquid sealing portion 30 forms a part of the upper face of the liquid storage portion 10. A bottom surface opening of the liquid storage portion 10 is covered by the base film 60 disposed on the other surface 52 of the body portion 50. As shown in FIG. 7A and FIG. 8, a non-penetrating recess 36 is formed in a back surface 35*b* on the side opposite to the pressure-receiving face 35*a* of the liquid sealing portion 30. As shown in FIG. 9 and FIG. 10, in the liquid sealing portion 30, the thickness of a portion in which the recess 36 is formed is reduced. The center-side low strength portion 31-1 disposed at the center portion 34 of the liquid sealing portion 30 is formed by the recess 36.

Thus, the center-side low strength portion 31-1 is formed by the recess 36 formed on the back side of the pressure-receiving face 35*a*. In a case where the recess 36 is disposed on the pressure-receiving face 35*a* side (see FIG. 16), when the center-side low strength portion 31 is broken and the base body portion 32 pivots, corner portions 36*a* (see FIG. 16) of the recess 36 formed in the pressure-receiving face 35*a* may come into contact with each other to prevent the pivoting. Meanwhile, in a case where the recess 36 is disposed on the back side of the pressure-receiving face 35*a* as shown in FIG. 10, the base body portion 32 pivots so as to separate the corner portions 36*a* from each other, thereby preventing contact between the corner portions 36*a*.

As shown in FIG. 9 and FIG. 10, the center-side low strength portion 31-1 has a thickness t1. In the region in which the projection 35*c* is formed so as to project, a region in which the recess 36 is not formed is the base body portion 32. The base body portion 32 has a thickness t2. The thickness t1 of the center-side low strength portion 31 is less than the thickness t2 of the base body portion 32.

In the example shown in FIG. 9 and FIG. 10, the liquid sealing portion 30 has the outer-circumferential-side low strength portion 31-2 in the outer circumferential portion 33. The outer-circumferential-side low strength portion 31-2 connects between the outer circumferential portion 33 and the projection 35*c*. The outer-circumferential-side low strength portion 31-2 has a thickness t3. The thickness t3 is less than the thickness t2 of the base body portion 32.

Thus, the low strength portion (31-1, 31-2) has a thickness less than that of the adjacent region. Thus, merely by reducing the thickness of the liquid sealing portion 30, the low strength portion can be easily formed.

(Second Specific Configuration Example of Liquid Sealing Portion)

FIG. 11 to FIG. 15 illustrate a second specific configuration example of the liquid sealing portion 30.

Figure 11:
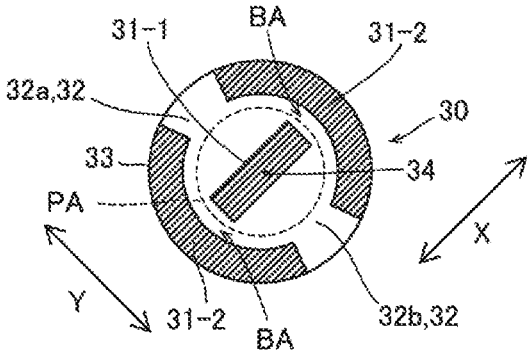
FIG. 11 is a schematic diagram illustrating a second specific configuration example of the liquid sealing portion.

In the second specific configuration example shown in FIG. 11, the liquid sealing portion 30 has a circular planar shape. The center-side low strength portion 31-1 has a linear shape that extends in the X-direction. A pair of the outer-circumferential-side low strength portions 31-2 are formed in the outer circumferential portion 33. Each of the paired outer-circumferential-side low strength portions 31-2 extends to both sides in the circumferential direction from a point of intersection of the extension of the center-side low strength portion 31-1 and the outer circumferential portion 33. The center-side low strength portion 31-1 and the pair of the outer-circumferential-side low strength portions 31-2 are closest to each other in the X-direction. The base body portion 32 continuously extends from the outer circumferential portion 33 of the liquid sealing portion 30 to the position of the center-side low strength portion 31-1 in the Y-direction orthogonal to the X-direction.

When the pressed region PA has been pressed, the center-side low strength portion 31-1 disposed in the pressed region PA is firstly broken, and the pair of the outer-circumferential-side low strength portions 31-2 are subsequently broken. During this process, a portion BA between the center-side low strength portion 31-1 and each of the paired outer-circumferential-side low strength portions 31-2 in the X-direction is broken, and a broken portion of the center-side low strength portion 31-1 and a broken portion of each of the paired outer-circumferential-side low strength portions 31-2 connect to each other. As a result, after the unsealing, the two portions, of the base body portion 32, which are the one side portion 32*a* and the other side portion 32*b* are pushed and spread in the Y-direction.

Figure 12A:
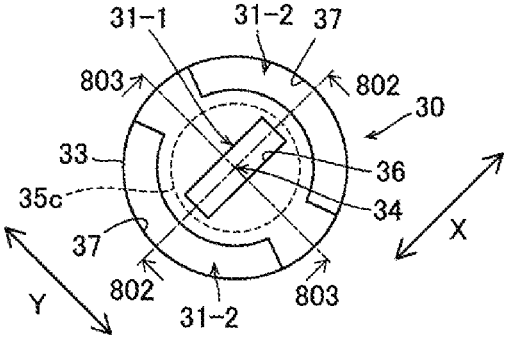
FIG. 12A is a plan view of the liquid sealing portion shown in FIG. 11 as viewed from the back surface side.
Figure 12B:
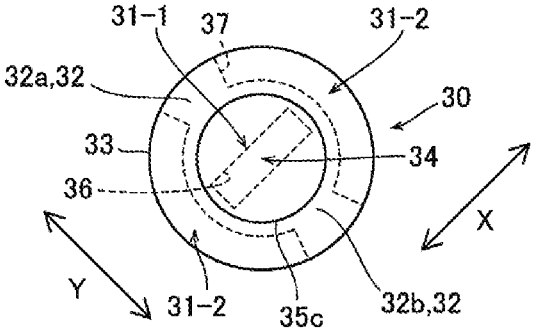
FIG. 12B is a plan view of the liquid sealing portion shown in FIG. 11 as viewed from a pressure-receiving face side.

In the second specific configuration example, the structure on the pressure-receiving face 35*a* side of the liquid sealing portion 30 shown in FIG. 12B is the same as the structure of the first specific configuration example shown in FIG. 7.

Figure 13:
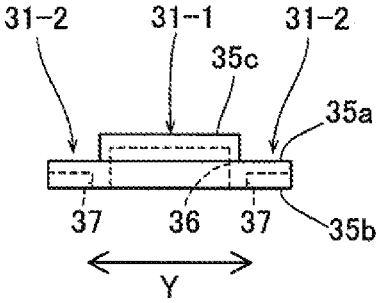
FIG. 13 is a schematic side view of the liquid sealing portion shown in FIG. 11.

In the example shown in FIG. 12A and FIG. 13, a linear recess 36 is formed in the back surface 35*b* of the liquid sealing portion 30. The center-side low strength portion 31-1 disposed at the center portion 34 of the liquid sealing portion 30 is formed by the recess 36.

A pair of recesses 37 are further formed along the outer circumferential portion 33 of the liquid sealing portion 30 in the back surface 35*b* of the liquid sealing portion 30. The pair of recesses 37 each extend so as to form an arc shape. The pair of the outer-circumferential-side low strength portions 31-2 are formed by the pair of recesses 37 in the outer circumferential portion 33.

Figure 14:
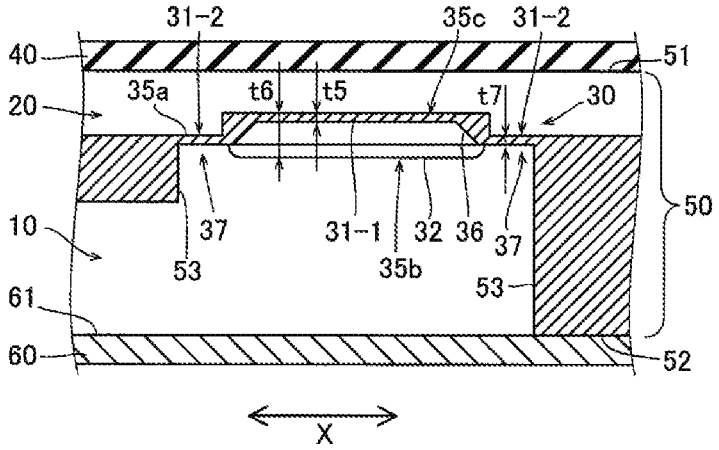
FIG. 14 is a cross-sectional view taken along a line 802-802 in FIG. 12A.
Figure 15:
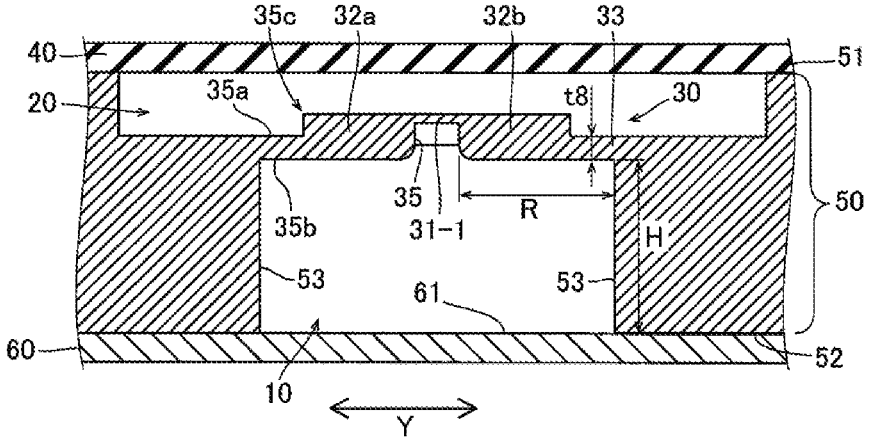
FIG. 15 is a cross-sectional view taken along a line 803-803 in FIG. 12A.

As shown in FIG. 14 and FIG. 15, the center-side low strength portion 31-1 has a thickness t5. The base body portion 32 adjacent to the center-side low strength portion 31-1 has a thickness t6. The thickness t5 of the center-side low strength portion 31-1 is less than the thickness t6 of the base body portion 32.

In the example shown in FIG. 14 and FIG. 15, the outer-circumferential-side low strength portion 31-2 has a thickness t7. The base body portion 32 adjacent to the outer-circumferential-side low strength portion 31-2 in the X-direction has a thickness t8. The thickness t7 is less than the thickness t8. The thickness t8 is less than the thickness t6, and the base body portion 32 has flexibility to some degree and acts as hinge during unsealing in a state where the base body portion is joined to the body portion 50.

As shown in FIG. 15, the liquid sealing portion 30 is disposed on the upper surface of the liquid storage portion 10, and a length R from the outer circumferential portion 33 to the center-side low strength portion 31-1 in the liquid sealing portion 30 is less than a depth H from the liquid sealing portion 30 to the inner bottom surface 61 of the liquid storage portion 10.

Thus, even when a range of the length R maximally pivots around the outer circumferential portion 33, the portion in the range does not come into contact with the inner bottom surface 61 of the liquid storage portion 10. Therefore, damage to the inner bottom surface 61 of the liquid storage portion 10 can be more assuredly inhibited.

(Cross-Sectional Shape of Low Strength Portion)

Figure 16:
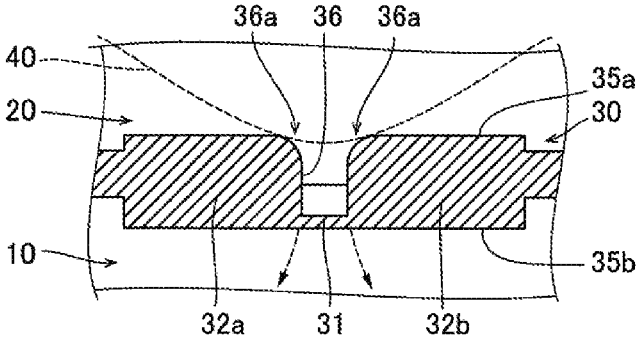
FIG. 16 illustrates a first configuration example as to a cross-sectional shape of the liquid sealing portion.

In the first and the second specific configuration examples, the center-side low strength portion 31-1 is formed by the recess 36 disposed in the back surface 35*b* of the liquid sealing portion 30. The center-side low strength portion 31-1 is not limited thereto. In FIG. 16, the center-side low strength portion 31 is formed by the recess 36 disposed in the pressure-receiving face 35*a* on the cover portion 40 side of the liquid sealing portion 30.

As described above, in a case where the width of the recess 36 is narrow, when the one side portion 32*a* and the other side portion 32*b* pivot, the corner portions 36*a* of the recess 36 formed in the pressure-receiving face 35*a* may come into contact with each other to prevent the pivoting. Therefore, as in FIG. 16, the corner portion 36*a* is preferably chamfered or the width of the recess 36 is preferably sufficiently increased.

In the examples shown in FIG. 9, FIG. 10, FIG. 14, and FIG. 15, the liquid sealing portion 30 has a plate-like shape parallel to the one surface 51 and the other surface 52 of the body portion 50. Meanwhile, FIG. 17 shows an example where the outer circumferential portion 33 of the liquid sealing portion 30 is tilted.

Figure 17:
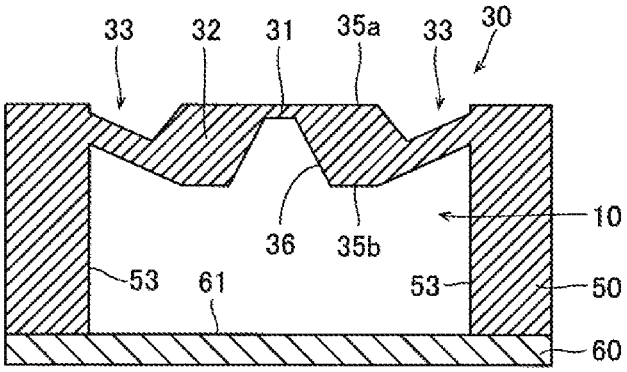
FIG. 17 illustrates a second configuration example as to a cross-sectional shape of the liquid sealing portion.

In FIG. 17, the outer circumferential portion 33 of the liquid sealing portion 30 is tilted toward the inner bottom surface 61 of the liquid-sealed cartridge 100. Thus, the outer circumferential portion 33 of the liquid sealing portion 30 is tilted beforehand toward the depth side in the pressing direction. Therefore, unsealing can be easily performed with a small stroke.

Figure 18:
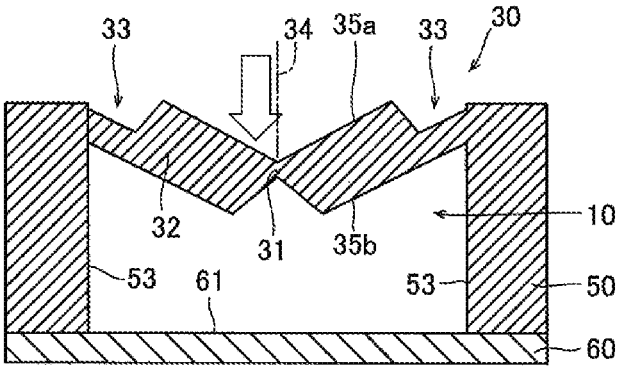
FIG. 18 illustrates a third configuration example as to a cross-sectional shape of the liquid sealing portion.

In FIG. 18, the pressure-receiving face 35*a* on the cover portion 40 side of the liquid sealing portion 30 is tilted toward the inner bottom surface 61 of the liquid-sealed cartridge 100. The pressure-receiving face 35*a* of the liquid sealing portion 30 is tilted from the outer circumferential portion 33 side so as to approach the inner bottom surface 61 at the center portion 34 side. In FIG. 18, the pressure-receiving face 35*a* is a tilted flat surface. However, the pressure-receiving face 35*a* may be curved. Thus, a load can be concentrated on the center-side low strength portion 31 in the center portion 34 of the liquid sealing portion 30 during pressing. Furthermore, even in a case where a pressing position of the pressing member 361 as indicated by an arrow slightly deviates from the center portion 34 of the liquid sealing portion 30 due to an error or the like, the tilted pressure-receiving face 35*a* functions as a guide and, thus, a pressing force assuredly acts on the center-side low strength portion 31.

(Specific Configuration Example of Liquid-Sealed Cartridge)

Next, a specific configuration example of the liquid-sealed cartridge 100 will be described.

Figure 19:
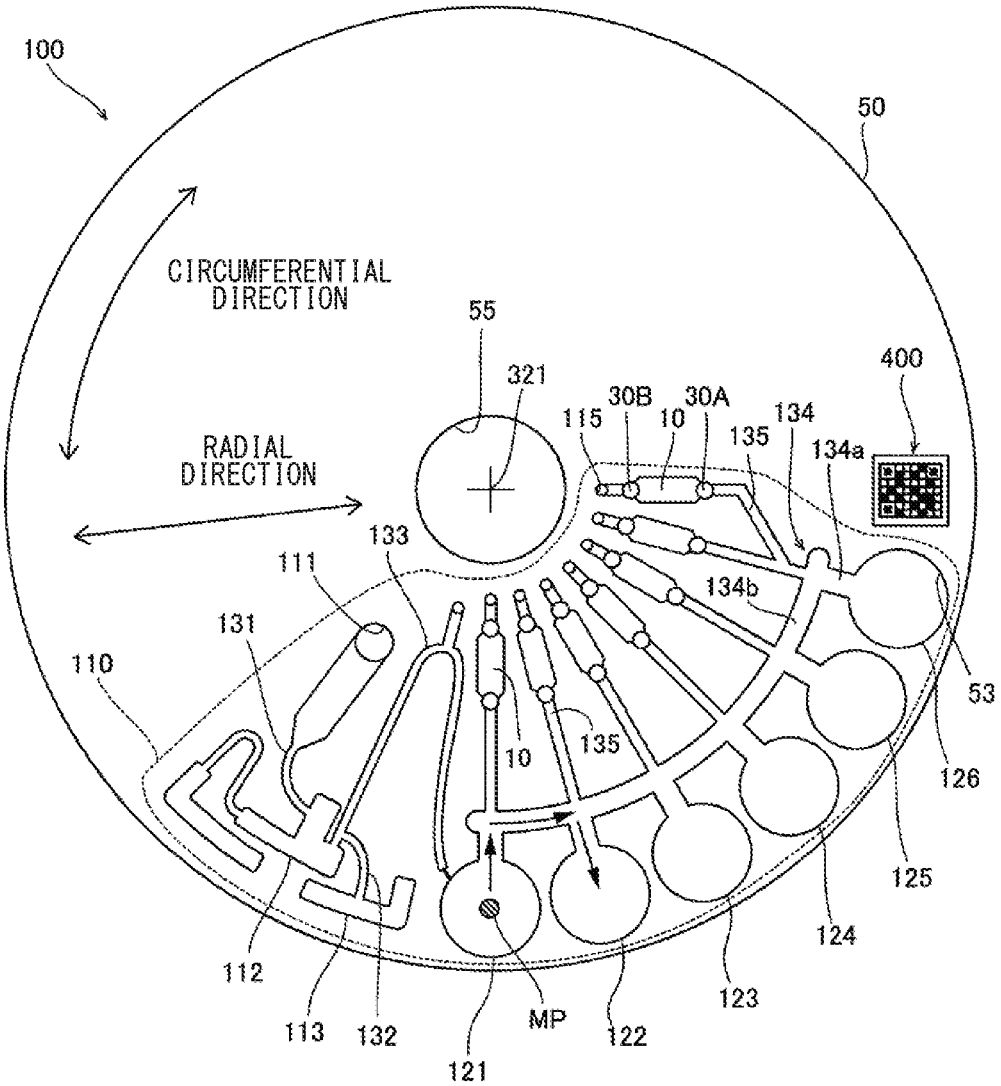
FIG. 19 is a plan view of a specific configuration example of the liquid-sealed cartridge.

The liquid-sealed cartridge 100 shown in FIG. 19 is disposed in a detection device 300 (see FIG. 20) for detecting light generated from a measurement sample that contains a test substance, and the liquid-sealed cartridge 100 is used for detecting light generated from the measurement sample.

A test substance is, for example, a substance contained in a specimen collected from a human subject. The specimen is, for example, blood (whole blood, serum, or plasma), urine, tissue fluid, or another liquid sample, or a sample obtained through a predetermined pretreatment of a collected liquid sample. The specimen contains liquid as a main component, and can contain a solid component such as a cell. The test substance can be, for example, protein such as an antigen or antibody, peptide, a cell and an intracellular substance, or nucleic acid such as DNA (deoxyribonucleic acid).

The measurement sample contains the test substance and a substance that generates light. The test substance itself may be a substance that generates light. The measurement sample may be a mixture of the test substance and a reagent. For example, the reagent causes luminescence according to an amount of the test substance. The luminescence is, for example, chemiluminescence or fluorescence. The reagent contains, for example, a labelling substance that specifically binds to a substance to be detected. The labelling substance may be a chemiluminescent substance or a fluorescent substance. For example, the labelling substance contains an enzyme, and the reagent contains a luminescent substrate that reacts with the enzyme. By detecting light generated from the measurement sample, for example, presence or absence of a test substance according to a measurement item, an amount or a concentration of the test substance, or the size or the shape of a particulate test substance can be measured. A kind of reagent to be mixed in the measurement sample varies depending on a measurement item. The liquid-sealed cartridge 100 may be varied among a plurality of kinds of the liquid-sealed cartridges 100 according to each measurement item. A plurality of different measurement items may be measured by the liquid-sealed cartridge 100.

The liquid-sealed cartridge 100 is implemented as a specimen processing cartridge in which a process for detecting a test substance in a specimen can be performed by utilizing an antigen-antibody reaction. The liquid 90 as a reagent used for preparing a measurement sample is stored in the liquid storage portion 10, and sealed by the liquid sealing portion 30A and the liquid sealing portion 30B.

In the example shown in FIG. 19, the liquid-sealed cartridge 100 has a flat-plate-like shape. The liquid-sealed cartridge 100 rotates around a rotation shaft 321. Specifically, the liquid-sealed cartridge 100 is a disk-shaped cartridge that includes the body portion 50 that is disk-shaped.

In the example shown in FIG. 19, the body portion 50 has such a thickness as to allow a heater 371 described below to easily adjust a temperature of the liquid-sealed cartridge 100. For example, the thickness of the body portion 50 is several mm. Specifically, the thickness is about 1.2 mm. The diameter of the body portion 50 ranges from several cm to about a dozen cm, and is, for example, about 12 cm.

The liquid-sealed cartridge 100 shown in FIG. 19 includes a processing region 110 in which a specimen is processed in the cartridge. In the example shown in FIG. 19, the liquid-sealed cartridge 100 has one processing region 110. In the example shown in FIG. 19, the processing region 110 is formed to be spread in a sector shape in a range of about 120° from the center of the body portion 50.

The liquid-sealed cartridge 100 has a flat-plate-like shape that rotates around the rotation shaft 321. The liquid-sealed cartridge 100 has a hole 55 that penetrates through the body portion 50 at the center of the body portion 50. The liquid-sealed cartridge 100 is disposed in the detection device 300 (see FIG. 20) such that the center of the hole 55 coincides with the center of the rotation shaft 321.

(Processing Region)

The processing region 110 includes an introduction inlet 111, a separator 112, a collection part 113, six chambers 121 to 126, flow paths 131 to 135, and seven liquid storage portions 10. Each of the seven liquid storage portions 10 has the liquid sealing portions 30A and 30B. A specimen is injected into the introduction inlet 111. The specimen is a whole blood specimen collected from a subject.

The separator 112, the collection part 113, and the chambers 121 to 126 are spaces in which liquid can be stored. The separator 112, the collection part 113, and the chambers 121 to 126 are each defined by a wall portion 53. The separator 112, the collection part 113, and the chambers 121 to 126 are aligned in the circumferential direction near the outer circumferential end portion of the body portion 50.

The separator 112 is connected to the introduction inlet 111 through the flow path 131. The specimen injected from the introduction inlet 111 is transferred through the flow path 131 to the separator 112 by a centrifugal force generated by rotation of the liquid-sealed cartridge 100.

The collection part 113 is disposed radially outward of the separator 112, and is connected to the separator 112 through the flow path 132. The specimen that flows through the flow path 131 into the separator 112 is sequentially accumulated from the radially outer side by the centrifugal force. When the specimen accumulated in the separator 112 has reached the flow path 132, the excess amount of the specimen which cannot be accumulated any more is moved into the collection part 113 by the action of the centrifugal force. Thus, a certain amount of the specimen is quantitatively stored in the separator 112.

The specimen in the separator 112 is centrifuged into plasma as a liquid component, and blood cells and other non-liquid components as solid components, by the centrifugal force generated by rotation of the liquid-sealed cartridge 100. The plasma separated by the separator 112 is moved into the flow path 133 by capillary phenomenon. The flow path 133 has the inner diameter reduced at a connecting portion immediately preceding the chamber 121. The flow path 133 that includes a portion immediately preceding the chamber 121 is filled with the plasma.

The flow path 133 is connected to the chamber 121. In a case where a centrifugal force is applied by rotation of the liquid-sealed cartridge 100 in a state where the flow path 133 is filled with the plasma, the plasma in the flow path 133 is transferred to the chamber 121. A predetermined amount of plasma to be transferred to the chamber 121 is quantitatively determined according to the volume of the flow path 133.

In the configuration example shown in FIG. 19, the chambers 121 to 126 are aligned in the circumferential direction so as to be adjacent to each other, and are connected to each other through the flow path 134 that extends in the circumferential direction. As described below, the test substance is sequentially transferred through the flow path 134 into the chambers 121 to 126 in order, respectively, from one side (chambers 121 side) toward the other side (chamber 126 side). Furthermore, reagents stored in the liquid storage portions 10 corresponding to the chambers 121 to 126 are separately transferred through the flow paths 135 into the chambers 121 to 126.

Liquid containing the test substance is transferred to the chamber 121 through the flow path 133. Magnetic particles MP are enclosed in the chamber 121. In the chamber 121, the test substance contained in the specimen and the magnetic particles MP form a complex. Therefore, the test substance bound to the magnetic particles MP is transferred to other chambers following the chamber 121 through the flow path 134 by combination of the rotation of the liquid-sealed cartridge 100 and the action of the magnetic force.

The flow path 134 includes six radial regions 134*a* that extend in the radial direction, and a circumferential region 134*b* that is arc-shaped and extends in the circumferential direction. The circumferential region 134*b* connects with the six radial regions 134*a*. Each of the six radial regions 134*a* connects to a corresponding one of the six chambers 121 to 126.

Each of the seven liquid storage portions 10 connects to the flow path 134 through a corresponding one of the flow paths 135 that extend in the radial direction. The five liquid storage portions 10 are provided for the chambers 121 to 125 in a one-to-one correspondence. The chamber 126 has two liquid storage portions 10. Each of the seven liquid storage portions 10 is aligned with a corresponding one of the chambers 121 to 126 in the radial direction. The seven liquid storage portions 10 in total are disposed on the inner circumferential side of the liquid-sealed cartridge 100, and the chambers 121 to 126 are disposed on the outer circumferential side of the liquid-sealed cartridge 100.

The liquid storage portion 10 stores a reagent that is the liquid 90. The liquid storage portion 10 includes two liquid sealing portions, which are the liquid sealing portions 30A and 30B, in both the end portions in the radial direction. When the liquid sealing portions 30A and 30B are unsealed, the reagent in the liquid storage portion 10 can flow into the flow path 135. When the liquid-sealed cartridge 100 is rotated, the reagent moves into a corresponding one of the chambers 121 to 126 by the centrifugal force.

A reagent with which one time measurement can be made is stored beforehand in each of the liquid storage portions 10. That is, the liquid-sealed cartridge 100 includes the liquid storage portions 10 each storing the reagent with which the test substance can be measured one time.

In the liquid-sealed cartridge 100, the test substance is carried by the magnetic particles MP in the chamber 121, and the test substance and the reagent are thereafter mixed in each of the chambers 122, 123, 124, and 125. The processing in the chambers 121 to 125 is determined according to an assay for detecting the test substance. For example, in the processing with the reagent, the test substance and the labelling substance are bound to each other. Ultimately, the magnetic particles MP that carry the test substance and the labelling substance are moved into the chamber 126. In the chamber 126, preparation of the measurement sample that causes luminescence is completed. A light detector 331 (see FIG. 22) of the detection device 300 detects light generated from the measurement sample.

In the example shown in FIG. 19, one processing region 110 is formed in the body portion 50. However, the configuration is not limited thereto. Two or more processing regions 110 may be formed. For example, three processing regions 110 may be formed so as to divide the body portion 50 into three equal parts at 120° intervals.

The number of each of the chambers and the flow paths and the shapes thereof are not limited to those shown in FIG. 19. The configuration of each portion of the processing region 110 is determined according to the contents of the specimen processing assay executed in the processing region 110.

(Liquid Storage Portion and Liquid Sealing Portion)

The configurations of the liquid storage portion 10 and the liquid sealing portion 30 will be described in detail. In the liquid-sealed cartridge 100 shown in FIG. 19, the liquid storage portion 10 is disposed on the center side of the body portion 50. The liquid storage portion 10 linearly extends in the radial direction. The liquid sealing portion 30A and the liquid sealing portion 30B are disposed on the outer-side end portion and the inner-side end portion, respectively, of the liquid storage portion 10 in the radial direction.

The radially inner-side end portion of the liquid storage portion 10 is connected to an air hole 115 through the liquid sealing portion 30B. The air hole 115 is opened to the outside of the liquid-sealed cartridge 100. The radially outer-side end portion of the liquid storage portion 10 is connected to the flow path 135 through the liquid sealing portion 30A.

The flow path 135 extends in the radial direction. In the flow path 135, the inner-side end portion in the radial direction is connected to one of the liquid storage portions 10 through the liquid sealing portion 30A, and the outer-side end portion in the radial direction is connected to one of the chambers 121 to 126. Thus, one liquid storage portion 10, one flow path 135, and one chamber are aligned in order, respectively, from the inner circumferential side along the radial direction of the body portion 50.

When the two liquid sealing portions, which are the liquid sealing portion 30A and the liquid sealing portion 30B, provided in one liquid storage portion 10 are unsealed, the inner-side end portion of the liquid storage portion 10 communicates with the outside of the liquid-sealed cartridge 100, and the outer-side end portion of the liquid storage portion 10 communicates with a corresponding chamber through the flow path 135.

The liquid 90 in the liquid storage portion 10 flows into the flow path 135 through the liquid sealing portion 30A by the centrifugal force caused by the rotation of the liquid-sealed cartridge 100, and flows into the chamber through the flow path 135. When the liquid 90 in the liquid storage portion 10 flows out, air outside the cartridge flows through the air hole 115 and the liquid sealing portion 30B.

The liquid sealing portion 30A and the liquid sealing portion 30B may have any of the various configurations described above as the examples. For example, the configuration shown as the example in FIG. 11 to FIG. 15 is adopted for the liquid sealing portion 30A and the liquid sealing portion 30B.

(Outline of Detection Device)

Next, a specific configuration example of the detection device 300 that performs a detection method according to the present embodiment will be described.

The detection device 300 performs measurement by using the liquid-sealed cartridge 100 (see FIG. 19) that is disk-shaped. In the example shown in FIG. 20 to FIG. 24, the detection device 300 is an immunoassay device that uses the liquid-sealed cartridge 100 to detect a test substance in a specimen by utilizing an antigen-antibody reaction, and that measures the test substance based on the detection result.

Figure 20:
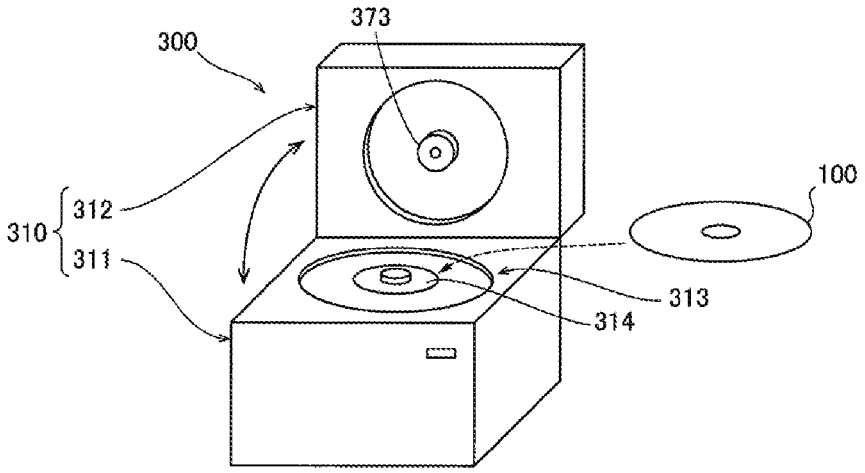
FIG. 20 is a perspective view of a specific example of a detection device using the liquid-sealed cartridge.
Figure 21:
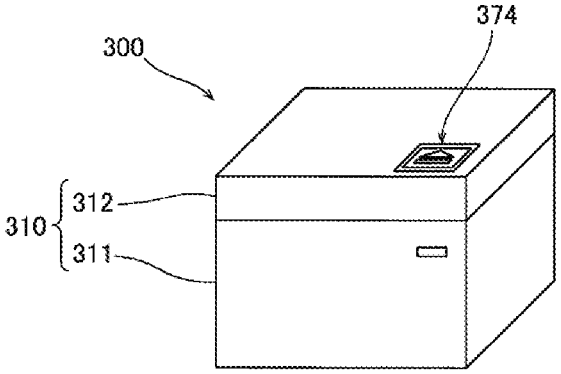
FIG. 21 is a perspective view of the detection device in which a lid portion is closed.

In the configuration example shown in FIG. 20 and FIG. 21, the detection device 300 includes a housing 310 capable of housing the liquid-sealed cartridge 100.

The housing 310 is formed by, for example, a box-shaped member having a predetermined volume of internal space, or combination of a frame and an external plate. The housing 310 has a small box-like shape and can be placed on a table or the like.

The housing 310 includes a base portion 311 and a lid portion 312. A placement portion 313 on which the liquid-sealed cartridge 100 is placed is disposed on the upper face portion of the base portion 311. The lid portion 312 pivots relative to the base portion 311 in the up-down direction and can be opened and closed between a position at which the placement portion 313 is opened as shown in FIG. 20 and a position at which the placement portion 313 is covered as shown in FIG. 21.

As a cartridge placing method, not only a method in which the lid portion 312 is opened and the cartridge is placed on the placement portion 313, but also a slot loading method in which the liquid-sealed cartridge 100 is inserted from an insertion opening formed in the housing 310, or a tray loading method in which the liquid-sealed cartridge 100 is placed on a tray that is moved between the outside and the inside of the housing 310, may be used.

Figure 22:
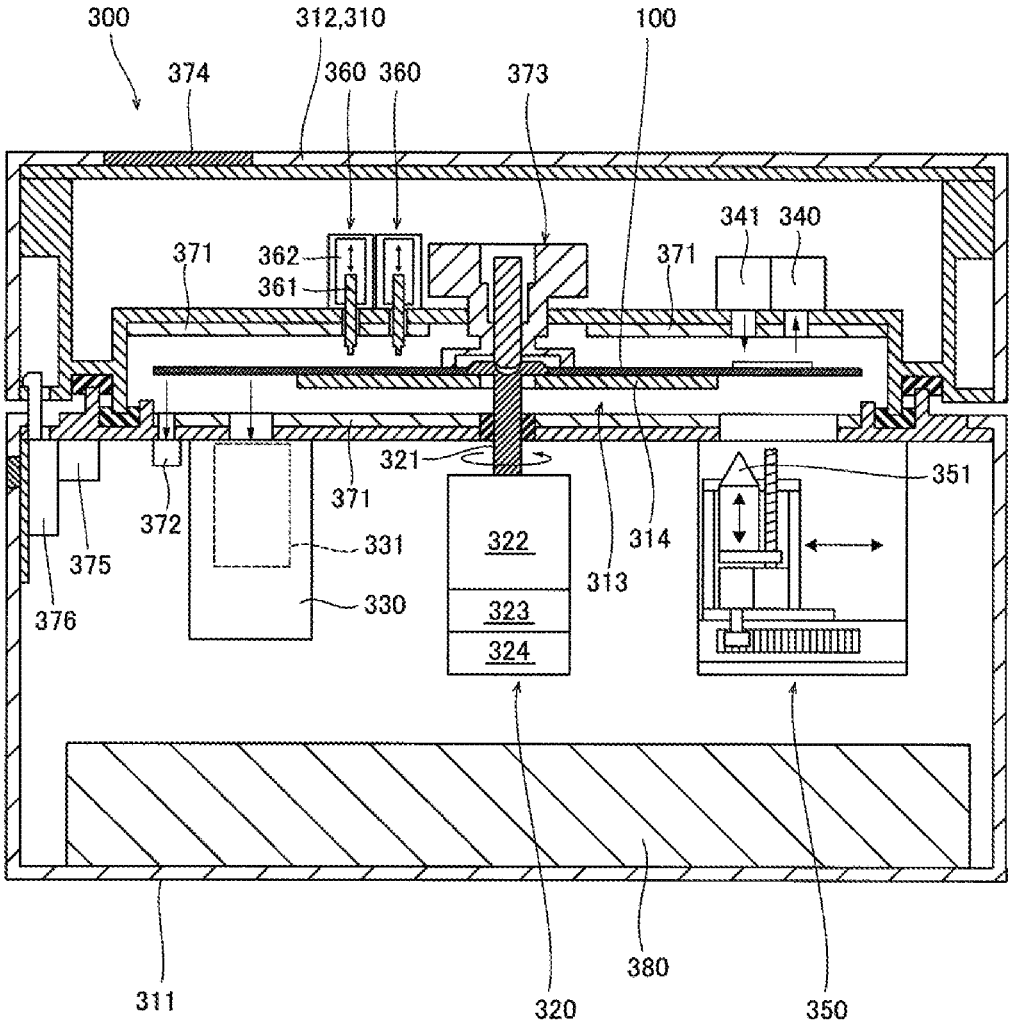
FIG. 22 is a schematic cross-sectional view of an internal structure of the detection device.

As shown in FIG. 22, the detection device 300 includes a rotation mechanism 320, a measurement unit 330, an imaging unit 340, and an illumination unit 341. The detection device 300 also includes a magnet driving unit 350, a pressing portion 360, a heater 371, a temperature sensor 372, and a clamper 373. These components are housed in the housing 310.

A support member 314 for supporting the liquid-sealed cartridge 100 from the lower side is disposed in the placement portion 313. The support member 314 is implemented by, for example, a turntable. The support member 314 is disposed at the upper end portion of the rotation shaft 321 of the rotation mechanism 320. The support member 314 is configured to support the liquid-sealed cartridge 100 at a predetermined relative rotation angle.

The clamper 373 supports the center portion of the upper face of the liquid-sealed cartridge 100 placed on the support member 314 such that the liquid-sealed cartridge 100 is rotatable in a state where the lid portion 312 is closed.

The rotation mechanism 320 includes the rotation shaft 321, and a driving unit 322 such as an electric motor. The rotation mechanism 320 drives the driving unit 322 to rotate the liquid-sealed cartridge 100 placed on the support member 314 around the rotation shaft 321. The rotation mechanism 320 includes an encoder 323 for detecting a rotation angle of the driving unit 322, and an origin sensor 324 for detecting an origin position of the rotation angle. The driving unit 322 is driven with respect to the position detected by the origin sensor 324 based on the angle detected by the encoder 323, whereby the liquid-sealed cartridge 100 can be moved to any rotational position.

The rotation mechanism 320 holds the liquid-sealed cartridge 100 through the rotation shaft 321. The rotation shaft 321 is oriented in the vertical direction in a state where, for example, the rotation shaft 321 is mounted to the detection device 300. The liquid-sealed cartridge 100 is supported in an orientation along the horizontal direction by the rotation mechanism 320.

The driving unit 322 rotates the rotation shaft 321 around the axis, whereby the liquid-sealed cartridge 100 rotates around the rotation shaft 321. As a result, the components such as the chambers 121 to 126 and the liquid storage portions 10 of the liquid-sealed cartridge 100 are each moved in the circumferential direction around the rotation shaft 321 on a circumferential trajectory with a rotation radius corresponding to a distance in the radial direction from a position where each component is disposed to the rotation shaft 321.

The magnet driving unit 350 includes a magnet 351, and has a function of moving the magnetic particles MP in the liquid-sealed cartridge 100 in the radial direction. The magnet driving unit 350 is disposed below the placement portion 313, and is configured to move the magnet 351 in the radial direction. The magnet driving unit 350 is configured to move the magnet 351 close to or away from the liquid-sealed cartridge 100. By moving the magnet 351 close to the liquid-sealed cartridge 100, the magnetic particles MP in the liquid-sealed cartridge 100 are magnetically collected. By moving the magnet 351 away from the liquid-sealed cartridge 100, magnetic collection of the magnetic particles MP is released.

Figure 23:
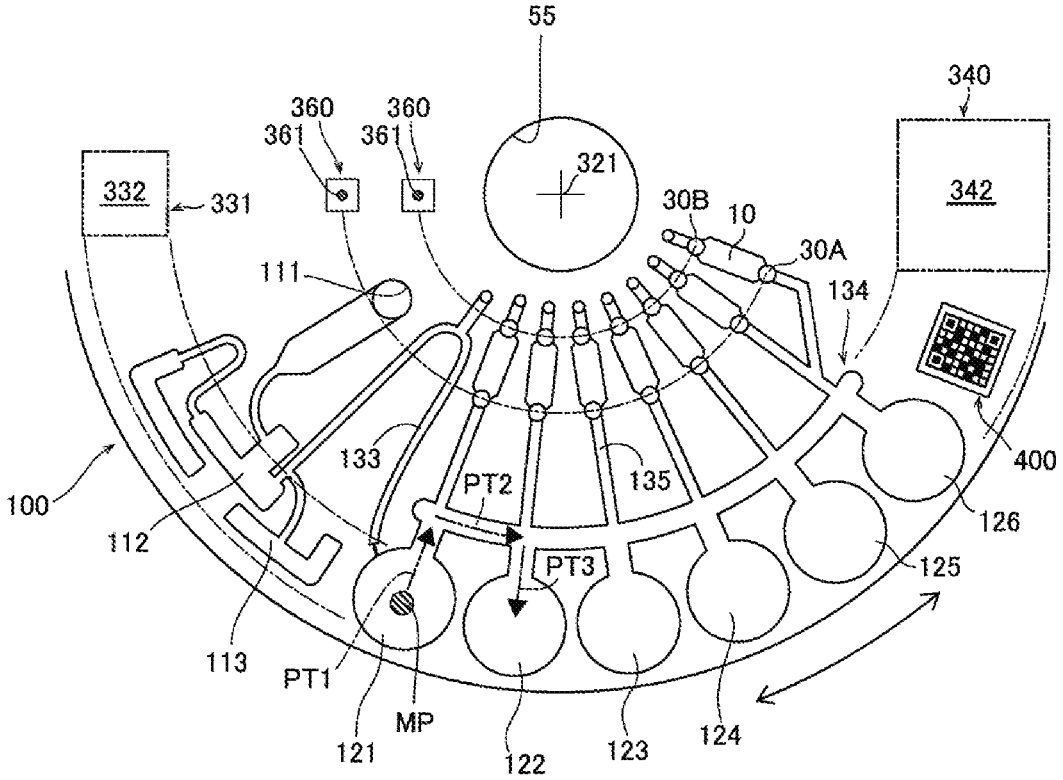
FIG. 23 illustrates positions of a pressing portion, an imaging unit, and a light detector relative to the cartridge.

The pressing portion 360 includes the pressing member 361 and a pressing driving unit 362 for moving the pressing member 361 in the up-down direction. The pressing member 361 is a bar-like pin-member that extends in the up-down direction, and has an outer diameter corresponding to the pressed region PA of the liquid sealing portion 30A or the liquid sealing portion 30B. The pressing driving unit 362 is configured by combination of a driving source such as an electric motor and a cam mechanism for transforming rotation by the driving source to upward-downward movement. The number of the pressing portions 360 is two such that the liquid sealing portion 30A and the liquid sealing portion 30B disposed at two positions in one liquid storage portion can be unsealed. As shown in FIG. 23, distances to the two pressing portions 360 from the rotation shaft 321 are substantially equal to distances to the two liquid sealing portions 30A, 30B, respectively, disposed in the liquid storage portion 10 from the rotation shaft 321, in a planar view.

The pressing portion 360 moves the pressing member 361 downward toward the liquid-sealed cartridge 100, from above the liquid-sealed cartridge 100 disposed in the placement portion 313, and brings the pressing member 361 into contact with the liquid-sealed cartridge 100. The pressing portion 360 causes the pressing member 361 to press the liquid sealing portion 30A and the liquid sealing portion 30B through the cover portion 40. The pressing portion 360 presses and thus unseals the liquid sealing portion 30A and the liquid sealing portion 30B in the liquid-sealed cartridge 100. After the unsealing, the pressing portion 360 moves the pressing member 361 upward away from the liquid-sealed cartridge 100 to a retracting position at which the pressing member 361 is not in contact with the liquid-sealed cartridge 100.

The heaters 371 are disposed vertically below the liquid-sealed cartridge 100 disposed on the placement portion 313 and vertically above the liquid-sealed cartridge 100 disposed thereon, respectively. The heaters 371 heat a sample stored in the liquid-sealed cartridge 100 to a predetermined reaction temperature, to promote reaction between the specimen and the reagent. The temperature sensor 372 detects a temperature of the liquid-sealed cartridge 100 by infrared rays.

The measurement unit 330 includes the light detector 331 at a position that opposes, through an opening formed in the base portion 311, the liquid-sealed cartridge 100 disposed on the placement portion 313. The light detector 331 detects light generated from the measurement sample having been moved to a detection position 332 (see FIG. 23). The light detector 331 outputs a pulse waveform according to reception of a photon. The measurement unit 330 has a circuit mounted therein, counts the photons at regular intervals based on an output signal from the light detector 331, and outputs a count value.

The light detector 331 is disposed vertically below the liquid-sealed cartridge 100 disposed on the placement portion 313. As shown in FIG. 23, the rotation mechanism 320 rotates the liquid-sealed cartridge 100 around the rotation shaft 321, to dispose the chamber 126 at the detection position 332 vertically above the light detector 331. Thus, the measurement unit 330 detects light generated from the chamber 126 by means of the light detector 331.

The imaging unit 340 is disposed so as to oppose the upper face of the liquid-sealed cartridge 100 disposed on the support member 314, and is configured to take an image of the liquid-sealed cartridge 100. Whether or not the process has been properly performed in the liquid-sealed cartridge 100 can be confirmed based on the obtained image. The imaging unit 340 includes, for example, a CCD image sensor or a CMOS image sensor. The illumination unit 341 is implemented by, for example, a light emitting diode, and generates illumination light when an image is taken.

The imaging unit 340 directly opposes the upper face of the liquid-sealed cartridge 100 through a hole formed in the lid portion 312. The illumination unit 341 directly opposes the upper face of the liquid-sealed cartridge 100 through a hole formed in the lid portion 312. An imaging range 342 (see FIG. 23) for the imaging unit 340 is set such that a part or the entirety of the chambers 121 to 126, the flow paths 131 to 135, and the like passes through the imaging range 342 when the liquid-sealed cartridge 100 disposed on the placement portion 313 is rotated. The imaging unit 340 uses the illumination light to obtain images of liquid and the magnetic particles MP in the liquid-sealed cartridge 100.

Furthermore, as shown in FIG. 23, the imaging unit 340 takes an image of an identifier 400 provided on the upper face of the liquid-sealed cartridge 100. The identifier 400 is an information storage medium such as a barcode or a two-dimensional code which can be read from an image. The rotation mechanism 320 rotates the liquid-sealed cartridge 100 to position the identifier 400 in the imaging range 342. Information for specifying a measurement item, information on a reagent, information for identifying the liquid-sealed cartridge 100, and the like are stored in the identifier.

In addition, the detection device 300 shown in FIG. 22 includes, for example, an operation unit 374 for receiving an operation of a user when the lid portion 312 is opened, a sensing unit 375 for detecting opening and closing of the lid portion 312, and a locking mechanism 376 for locking the lid portion 312 by engaging with the lid portion 312 in a closed state.

Figure 24:
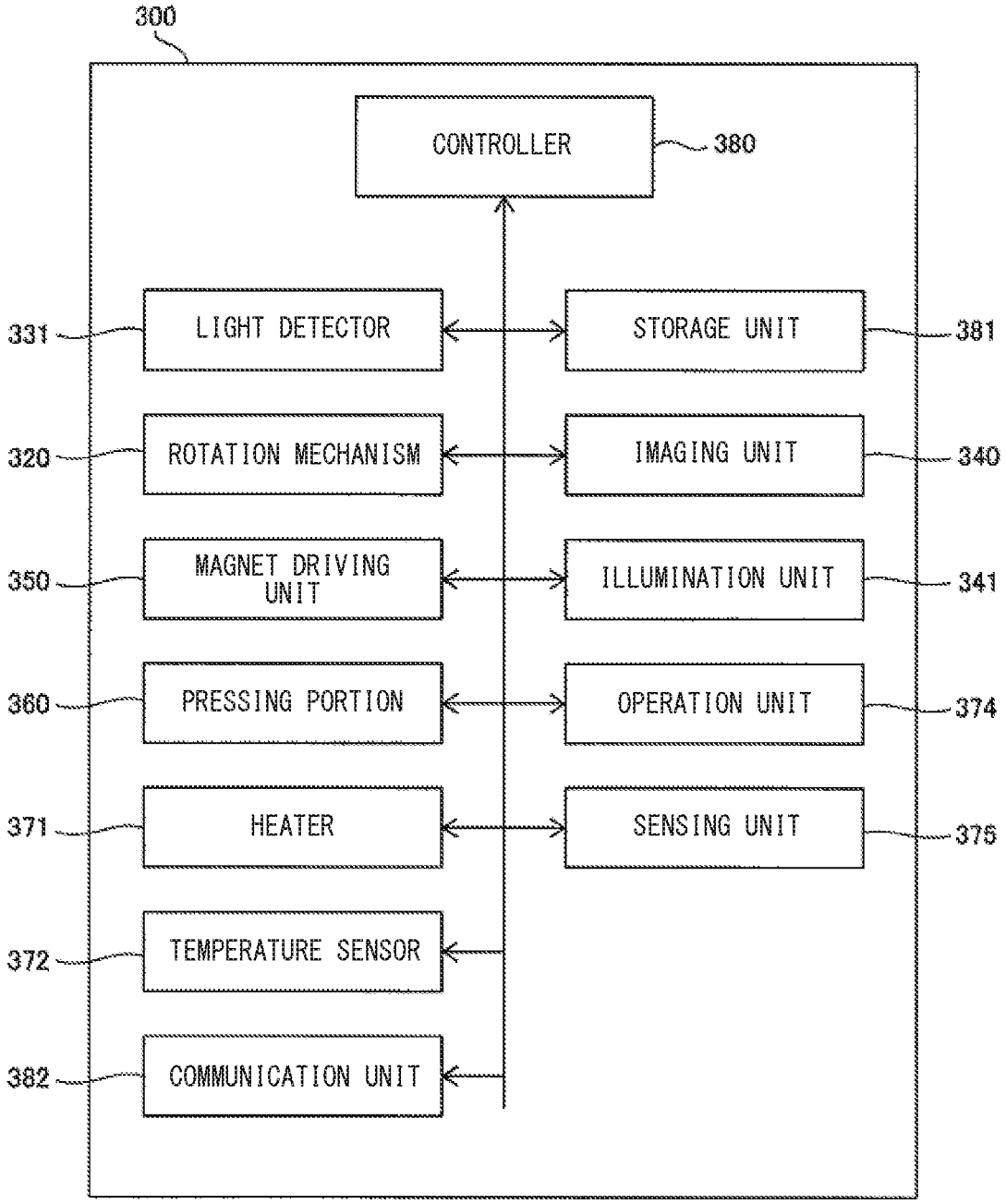
FIG. 24 is a block diagram illustrating a relationship between each component of the detection device and a controller.

FIG. 24 is a block diagram illustrating a relationship between each of the components of the detection device 300 shown in FIG. 22, and a controller 380 for controlling the components by control signals.

The detection device 300 includes the controller 380. The controller 380 includes, for example, a processor and a memory. The processor is implemented by, for example, a CPU and an MPU. The memory is implemented by, for example, a ROM and a RAM. The controller 380 receives a signal from each component of the detection device 300 and controls each component of the detection device 300.

The detection device 300 includes a storage unit 381. Measurement result data is stored in the storage unit 381. The storage unit 381 is implemented by, for example, a flash memory or a hard disk.

The detection device 300 includes a communication unit 382. The communication unit 382 can transmit information to an external device and receive information from an external device. The communication unit 382 includes, for example, a communication module and an interface for connection to the outside. The communication unit 382 can perform wired or wireless communication with a terminal capable of communicating with the detection device 300, and with a server via a network. The communication allows transmission of log including measurement result data, and allows obtaining of data, such as a calibration curve, associated with a measurement process. Examples of the terminal include a tablet terminal, a mobile information terminal such as a smartphone, and an information terminal such as a PC (personal computer). The controller 380 can receive an operation input from a user through a user-interface displayed on the terminal.

(Description of Operation of Detection Device)

Next, an operation performed by the detection device 300 will be described with reference to FIG. 25. The configuration of the detection device 300 will be described below with reference to FIG. 22 and FIG. 23. The configuration of the liquid-sealed cartridge 100 will be described below with reference to FIG. 19.

Firstly, a user injects a blood specimen collected from a subject from the introduction inlet 111 of the liquid-sealed cartridge 100 in a preparation operation. The user injects a specimen to be measured into the introduction inlet 111. An example where hepatitis B surface antigen (HBsAg) is measured as the measurement item of the liquid-sealed cartridge 100 will be described. The test substance in the blood specimen contains an antigen. The antigen is the hepatitis B surface antigen (HBsAg). The measurement item may be prostate-specific antigen (PSA), thyroid-stimulating hormone (TSH), thyroid hormone (FT4), or the like.

In the liquid-sealed cartridge 100, R1 reagent is stored in the liquid storage portion 10 disposed in the radial direction of the chamber 121. R2 reagent containing the magnetic particles MP is stored in the chamber 121. R3 reagent is stored in the liquid storage portion 10 disposed in the radial direction of the chamber 122. Washing liquid is stored in each of the liquid storage portions 10 disposed in the radial direction of the chambers 123 to 125. R4 reagent is stored in the liquid storage portion 10 disposed in the radial direction of the chamber 126. R5 reagent is stored in another liquid storage portion 10 disposed in the radial direction of the chamber 126.

Figure 25:
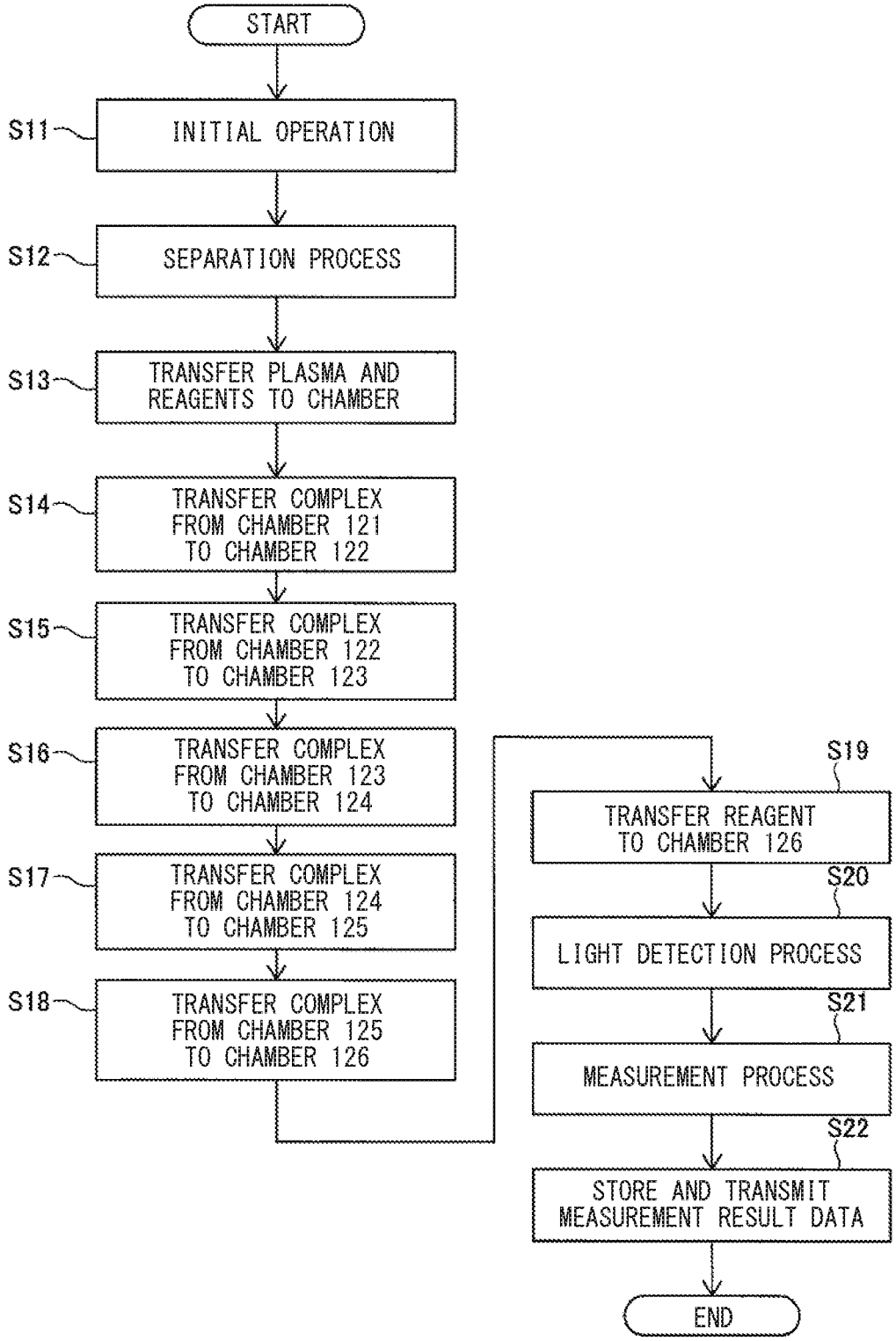
FIG. 25 is a flow chart showing an operation performed by the detection device.

In step S11 in FIG. 25, the controller 380 performs an initial operation for starting the measurement.

Specifically, the controller 380 performs control to detect that the lid portion 312 is closed based on a signal from the sensing unit 375. The controller 380 performs control to read the identifier 400. The imaging unit 340 takes an image of the identifier 400, whereby the controller 380 obtains various information used for the measurement. Furthermore, the controller 380 obtains rotational positions of the chambers 121 to 126 and the seven pairs of the liquid sealing portion 30A and the liquid sealing portion 30B disposed in the seven liquid storage portions 10 based on the origin position detected by the origin sensor 324 and the position at which the identifier 400 is read.

The controller 380 causes the detection device 300 to start an operation for processing a specimen in step S12 and subsequent steps. In each step, the controller 380 causes the rotation mechanism 320 to position a portion in which the specimen has been processed, in the imaging range 342 for the imaging unit 340, and causes the imaging unit 340 to take an image. The controller 380 determines through monitoring whether or not the specimen has been properly processed based on the image taken by the imaging unit 340. In a case where the specimen has not been properly processed, the controller 380 performs a predetermined error process. In the description herein, the detailed description thereof is omitted.

In step S12, the controller 380 performs control to separate the specimen into a liquid component and a solid component. The controller 380 causes the rotation mechanism 320 to rotate the liquid-sealed cartridge 100 at a high speed, to move the specimen from the flow path 131 to the separator 112 by the centrifugal force. At this time, an excess amount of specimen exceeding a predetermined amount is moved to the collection part 113. In the separator 112, the specimen is separated into a liquid component that is plasma, and a solid component such as blood cells by the centrifugal force. The separated plasma is moved into the flow path 133, and the flow path 133 is filled with the plasma.

In step S13, the controller 380 performs control to transfer the plasma and the reagents into the chambers. That is, the controller 380 performs control for steps S31 to S33 in FIG. 26 to cause the pressing portion 360 to sequentially unseal the liquid sealing portion 30A and the liquid sealing portion 30B of each of the six liquid storage portions 10, rotate the liquid-sealed cartridge 100, and transfer the liquids 90 stored in the six liquid storage portions 10 disposed in the radial direction of the chambers 121 to 126, through the flow paths 135, to the chambers 121 to 126, respectively. The plasma in the flow path 133 is transferred to the chamber 121 by the rotation of the liquid-sealed cartridge 100. The liquids 90 transferred from the six liquid storage portions 10 are the R1 reagent, the R2 reagent, the R3 reagent, the washing liquid, and the R4 reagent. Steps S31 to S33 will be described below in detail.

Thus, the R1 reagent and the plasma are transferred to the chamber 121, and the plasma, the R1 reagent, and the R2 reagent are mixed in the chamber 121. The R3 reagent is transferred to the chamber 122. The washing liquid is transferred to each of the chambers 123 to 125. The R4 reagent is transferred to the chamber 126.

When the reagents have been transferred in step S13, the controller 380 further performs control for a stirring process. Specifically, the controller 380 drives the rotation mechanism 320 such that switching between two different rotation speeds is performed at predetermined time intervals while the rotation in a predetermined direction is performed. Thus, liquid in each of the chambers 121 to 126 is stirred. The stirring process is also performed similarly at the end of each of steps S14 to S19 as well as in step S13.

The R1 reagent includes a capture substance to be bound to the test substance. The capture substance includes, for example, an antibody to be bound to the test substance. The antibody is, for example, a biotin-bound HBs monoclonal antibody. The R2 reagent includes the magnetic particles MP. The magnetic particles MP are, for example, streptavidin-bound magnetic particles the surfaces of which are coated with avidin. In step S13, the plasma, the R1 reagent, and the R2 reagent are mixed and stirred, whereby the test substance and the R1 reagent bind to each other through an antigen-antibody reaction. By reaction between the antigen-antibody reaction product and the magnetic particles MP, the test substance bound to the capture substance in the R1 reagent binds to the magnetic particles MP through the capture substance. As a result, a complex in which the test substance and the magnetic particles MP bind to each other, is generated.

Next, in step S14, the controller 380 performs control to transfer the complex in the chamber 121 from the chamber 121 to the chamber 122.

When the complex is transferred, the controller 380 drives the magnet driving unit 350 to move the magnet 351 close to the liquid-sealed cartridge 100 and collect the complex that is spread in the chamber 121. The controller 380 performs control to move the complex along the flow path 134 by combination of movement of the magnet 351 in the radial direction through the driving of the magnet driving unit 350 and movement of the liquid-sealed cartridge 100 in the circumferential direction by the rotation mechanism 320. That is, the controller 380 performs control to move the complex to the chamber 122 from the chamber 121 by moving the complex through a route PT1 shown in FIG. 23 in the radially inward direction, moving the complex through a route PT2 in the circumferential direction, and moving the complex through a route PT3 in the radially outward direction in order, respectively. The controller 380 performs control to perform a stirring process after the complex has been moved. The complex is moved to each of the chambers 123 to 126 in the same manner, and the detailed description is omitted.

By transferring the complex to the chamber 122, the complex generated in the chamber 121 and the R3 reagent are mixed in the chamber 122. The R3 reagent includes a labelling substance. The labelling substance includes a capture substance that specifically binds to the test substance, and a label. For example, the labelling substance is a labelling antibody in which an antibody is used as the capture substance. In step S14, the complex generated in the chamber 121 and the R3 reagent are mixed and stirred, whereby the complex generated in the chamber 121 and the labelling antibody included in the R3 reagent react with each other. As a result, a complex in which the test substance, the capture antibody, the magnetic particles MP, and the labelling antibody are bound is generated in the chamber 122.

In step S15, the controller 380 performs control to transfer the complex in the chamber 122 from the chamber 122 to the chamber 123. Thus, the complex generated in the chamber 122 and the washing liquid are mixed in the chamber 123. The stirring process is performed in step S15, and the complex and unreacted substances are separated in the chamber 123. That is, the unreacted substances are removed by the washing in the chamber 123.

In step S16, the controller 380 performs control to transfer the complex in the chamber 123 from the chamber 123 to the chamber 124. Thus, the complex generated in the chamber 122 and the washing liquid are mixed in the chamber 124. Also in chamber 124, the unreacted substances are removed by the washing.

In step S17, the controller 380 performs control to transfer the complex in the chamber 124 from the chamber 124 to the chamber 125. Thus, the complex generated in the chamber 122 and the washing liquid are mixed in the chamber 125. Also in the chamber 125, the unreacted substances are removed by the washing.

In step S18, the controller 380 performs control to transfer the complex in the chamber 125 from the chamber 125 to the chamber 126. Thus, the complex generated in the chamber 122 and the R4 reagent are mixed in the chamber 126. The R4 reagent is a reagent for dispersing the complex generated in the chamber 122. The R4 reagent is, for example, a buffer solution. The stirring process is performed in step S18, whereby the complex generated in the chamber 122 is dispersed in the R4 reagent in the chamber 126.

In step S19, the controller 380 performs control to transfer the R5 reagent to the chamber 126. Specifically, the controller 380 performs control for steps S31 to S33 in FIG. 26 to unseal the liquid sealing portion 30A and the liquid sealing portion 30B of the liquid storage portion 10, and transfer the R5 reagent stored in the liquid storage portion 10 to the chamber 126 by the rotation of the liquid-sealed cartridge 100. Thus, the R5 reagent is further mixed in the mixture generated in step S18 in the chamber 126.

The R5 reagent includes a luminescent substrate that generates light by reaction with the labelling antibody bound to the complex. In step S19, the mixture generated in step S18 and the R5 reagent having been additionally transferred are mixed and stirred, thereby preparing the measurement sample. The measurement sample causes chemiluminescence by reaction between the labelling substance bound to the complex and the luminescent substrate.

In step S20, the controller 380 causes the rotation mechanism 320 to position the chamber 126 at the detection position 332 vertically above the light detector 331. The light detector 331 detects light emitted from the chamber 126.

In step S21, the controller 380 performs measurement process for immunity based on the light detected by the light detector 331. The measurement unit 330 counts photons and output the count value. The controller 380 determines whether or not the test substance is present and measures an amount of the test substance and the like based on the count value outputted by the measurement unit 330, and the calibration curve to generate a measurement result.

When the measurement result has been obtained, the controller 380 causes the storage unit 381 to store the measurement result data in step S22. Furthermore, the controller 380 causes the communication unit 382 to transmit the measurement result data to the terminal or the server.

Thus, the measurement operation by the detection device 300 is completed.

(Liquid Sending Process)

Figure 26:
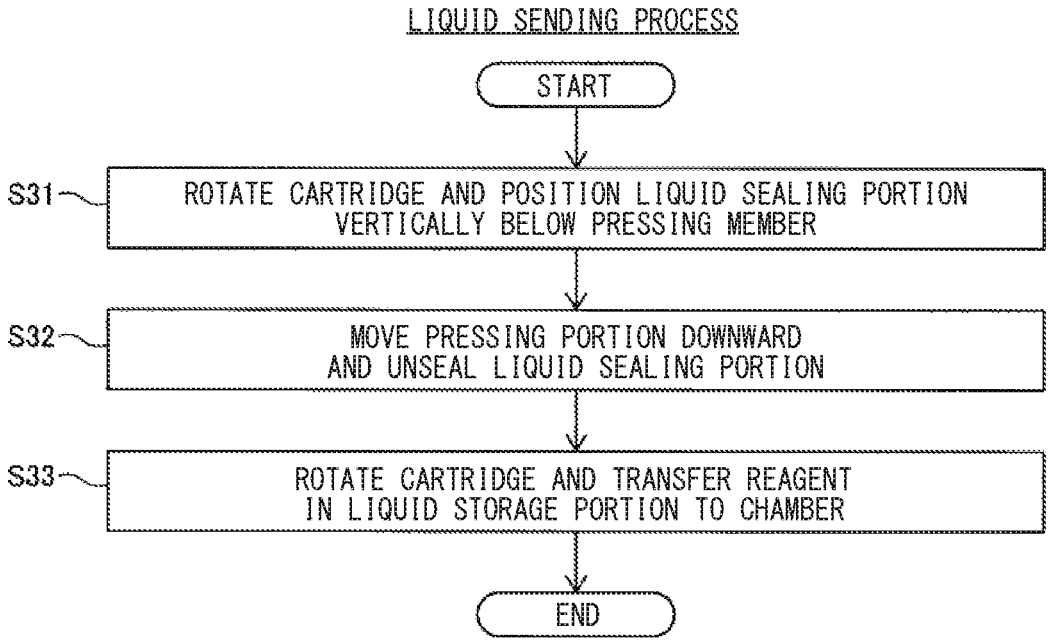
FIG. 26 is a flow chart showing a liquid sending process performed by the detection device.

Next, a liquid sending process performed by the detection device 300 will be described with reference to FIG. 26. The liquid sending process shown in FIG. 26 is performed in steps S13 and S19 in FIG. 25. The liquid sending process shown in FIG. 26 is performed by the liquid sending method of the present embodiment.

The liquid sending method of the present embodiment includes step S31 prior to step S32 of pressing the center-side low strength portion 31. In step S31, at least one of the body portion 50 in which the liquid storage portion 10, and the liquid sealing portion 30A and the liquid sealing portion 30B are formed, and the pressing member 361 for pressing the liquid sealing portion 30A and the liquid sealing portion 30B is moved to align the pressing position with the liquid sealing portion 30A and the liquid sealing portion 30B.

Thus, the center-side low strength portion 31 in each of the liquid sealing portion 30A and the liquid sealing portion 30B can be more assuredly pressed. By applying the pressing force directly to the center-side low strength portion 31, the liquid sealing portion 30A and the liquid sealing portion 30B can be unsealed by a reduced load (pressing force).

Figure 27:
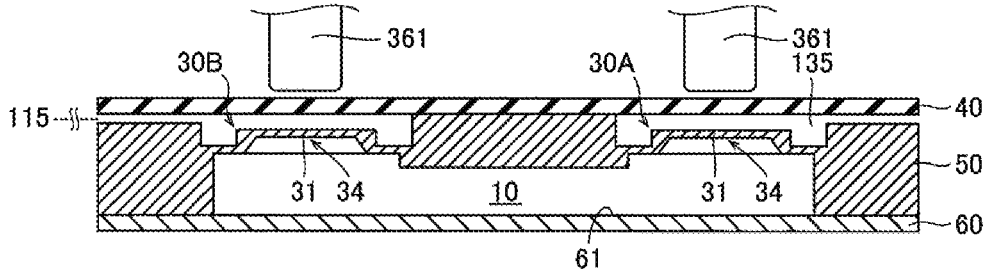
FIG. 27 is a schematic diagram illustrating a state where the liquid sealing portion is disposed vertically below the pressing portion.

Specifically, in step S31 for pressing position alignment, the body portion 50 is moved to align the pressing position of the pressing member 361 with the center-side low strength portion 31. That is, the controller 380 drives the rotation mechanism 320 to rotate the liquid-sealed cartridge 100 and position the liquid sealing portion 30A and the liquid sealing portion 30B aligned in the radial direction vertically below the two pressing members 361 as shown in FIG. 27.

Thus, the liquid-sealed cartridge 100 is moved relative to the pressing member 361, whereby a pressing device can be fixed. Load applied for pressing can be easily addressed as compared with a structure in which the pressing device is moved.

Figure 28:
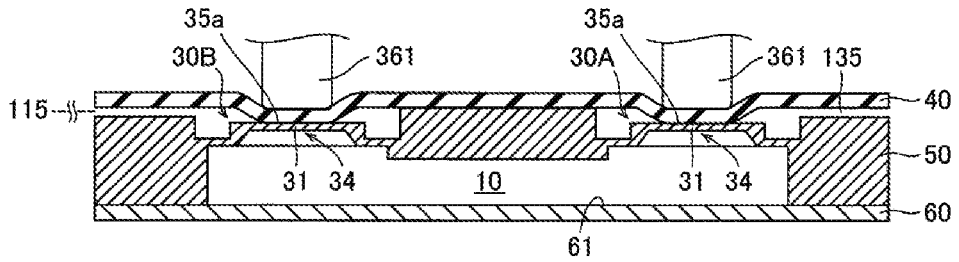
FIG. 28 is a schematic diagram illustrating a state where a pressing member is pressing the liquid sealing portion.

Next, in step S32, the controller 380 performs control to move the two pressing portions 360 downward and press the liquid sealing portion 30A and the liquid sealing portion 30B. The liquid sealing portion 30A and the liquid sealing portion 30B are unsealed by the pressing. As shown in FIG. 28, while the cover portion 40 is elastically deformed, the pressing member 361 comes into contact with the pressure-receiving face 35*a* of each of the liquid sealing portion 30A and the liquid sealing portion 30B through the cover portion 40.

As shown in FIG. 28, in step S32 of pressing the center-side low strength portion 31, a portion near the center portion 34 of each of the liquid sealing portion 30A and the liquid sealing portion 30B is pressed by the pressing member 361 having a pin-like shape through the cover portion 40 opposing the liquid sealing portion 30A and the liquid sealing portion 30B.

Thus, the liquid sealing portion 30A and the liquid sealing portion 30B are pressed through the cover portion 40 while being covered by the cover portion 40, whereby the liquid sealing portion 30A and the liquid sealing portion 30B can be unsealed without causing leakage of liquid. In this case, the cover portion 40 may be damaged by increasing the indentation depth for pressing. However, in the present embodiment, the indentation depth for pressing can be reduced, so that not only the inner bottom surface 61 but also the cover portion 40 can be inhibited from being damaged.

Figure 29:
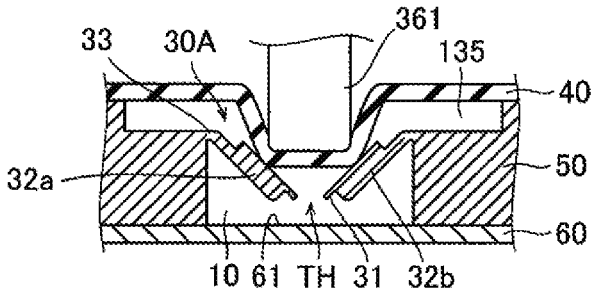
FIG. 29 is a schematic diagram illustrating a state where the liquid sealing portion has been unsealed by the pressing member.

In step S32, in a case where the controller 380 further drives the pressing portion 360 to cause the pressing member 361 to apply the pressing force to the liquid sealing portion 30A and the liquid sealing portion 30B, the liquid sealing portion 30A and the liquid sealing portion 30B are each broken at the center-side low strength portion 31 serving as the boundary as shown in FIG. 29. In step S32 of pressing the center-side low strength portion 31, the one side portion 32*a* on one side of the center-side low strength portion 31 and the other side portion 32*b* on the other side thereof are deformed in the pressing direction. The one side portion 32*a* and the other side portion 32*b* pivot so as to separate from each other, so that the through hole TH is spread by pushing.

Thus, while the center-side low strength portion 31 is broken to form the through hole TH, the one side portion 32*a* and the other side portion 32*b* can be deformed to spread the through hole TH by pushing. The one side portion 32*a* and the other side portion 32*b* are merely deformed and do not separate from each of the liquid sealing portion 30A and the liquid sealing portion 30B. Therefore, the one side portion 32*a* or the other side portion 32*b* can be inhibited from falling into the liquid storage portion 10 and hindering liquid sending.

The controller 380 performs control to move the pressing member 361 upward to the upper limit position above the liquid-sealed cartridge 100 after the pressing member 361 has been moved to the lower limit position. The lower limit position of the pressing member 361 is a position between each of the liquid sealing portion 30A and the liquid sealing portion 30B, and the inner bottom surface 61 of the liquid storage portion 10.

Thus, in step S32 of pressing the center-side low strength portion 31, the liquid sealing portion 30A and the liquid sealing portion 30B are pressed through the cover portion 40 from above the liquid sealing portion 30A and the liquid sealing portion 30B to the position between each of the liquid sealing portion 30A and the liquid sealing portion 30B, and the inner bottom surface 61 of the liquid storage portion 10. Thus, the pressing member 361 can stop the pressing before coming into contact with the inner bottom surface 61 of the liquid storage portion 10, whereby damage to the inner bottom surface 61 can be more assuredly inhibited.

As described above, as shown in FIG. 30, the liquid sealing portion 30A and the liquid sealing portion 30B are unsealed. That is, the liquid storage portion 10 communicates with the air hole 115 and the flow path 135.

In step S13 shown in FIG. 25, the controller 380 repeats such an unsealing operation, and unseals the six liquid sealing portions 30A and the six liquid sealing portions 30B disposed in the radial direction of the chambers 121 to 126. In step S19 shown in FIG. 25, the controller 380 performs control to unseal the liquid sealing portion 30A and the liquid sealing portion 30B of the liquid storage portion 10 in which the R5 reagent is stored.

Figure 30:
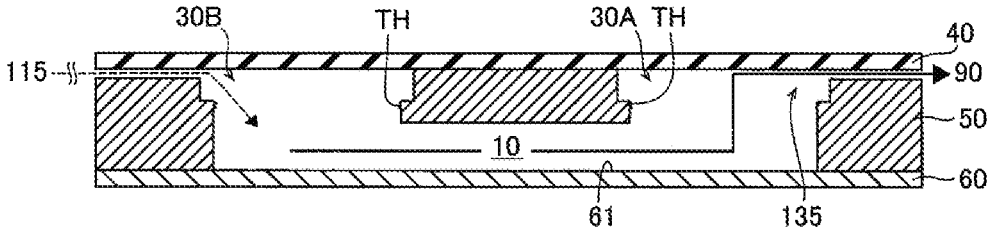
FIG. 30 is a schematic diagram illustrating a state where liquid is sent after the liquid sealing portion has been unsealed.

Next, in step S33, the controller 380 causes the rotation mechanism 320 to rotate the liquid-sealed cartridge 100 such that the liquid 90 in the liquid storage portion 10 flows into the flow path 20 through the center-side low strength portion 31 having been pressed. As shown in FIG. 30, the liquid 90 stored in the liquid storage portion 10 flows into the flow path 135 by the rotation of the liquid-sealed cartridge 100. As a result, the reagent in the liquid storage portion 10 is moved into a corresponding one of the chambers through the flow path 135.

The liquid sending process is performed as described above.

In the present embodiment, chemiluminescence represents light generated by using energy caused by a chemical reaction, and, for example, represents light emitted when molecules excited into an excited state by a chemical reaction, are returned from the excited state to a ground state. For example, the chemiluminescence can be generated by a reaction between an enzyme and a substrate, can be generated by applying electrochemical stimuli to a labelling substance, can be generated by an LOCI (luminescent oxygen channeling immunoassay), or can be generated according to bioluminescence. In the present embodiment, the chemiluminescence may be of any type. A complex may be formed by binding a test substance and a substance which is excited to generate fluorescence when light having a predetermined wavelength is applied. In this case, a light source for applying light to the chamber 126 is disposed. The light detector detects fluorescence generated when a substance bound to the complex is excited by the light from the light source.

The magnetic particles MP may be any particles that contain a magnetic material as a base and are used for standard immunoassay. For example, magnetic particles containing, as the base, $Fe_2O_3$ and/or $Fe_3O_4$, cobalt, nickel, ferrite, magnetite, or the like, can be used. The magnetic particles may be coated with a binding substance for binding to a test substance, or may bind to a test substance by means of a capture substance for binding the magnetic particles and the test substance to each other. The capture substance is an antigen, an antibody, or the like that binds the magnetic particles and the test substance mutually to each other.

The capture substance is not particularly limited as long as the capture substance specifically binds to a test substance. For example, the capture substance binds to a test substance by an antigen-antibody reaction. More specifically, the capture substance is an antibody. When the test substance is an antibody, the capture substance may be an antigen of the antibody. When the test substance is a nucleic acid, the capture substance may be a nucleic acid that is complementary to the test substance. Examples of the label contained in the labelling substance include an enzyme and a fluorescent substance. Examples of the enzyme include alkaline phosphatase (ALP), peroxidase, glucose oxidase, tyrosinase, and acid phosphatase. When chemiluminescence is electrochemiluminescence, the label is not particularly limited as long as the label is a substance that emits light by electrochemical stimuli. Examples of the label include a ruthenium complex. Examples of the fluorescent substance include fluorescein isothiocyanate (FITC), green fluorescent protein (GFP), and luciferin.

Furthermore, when the label is an enzyme, a luminescent substrate for the enzyme may be selected from known luminescent substrates as appropriate according to the enzyme to be used. For example, in a case where alkaline phosphatase is used as the enzyme, examples of the luminescent substrate include: chemiluminescent substrates such as CDP-Star (registered trademark), (disodium 4-chloro-3-(methoxyspiro[1,2-dioxetane-3,2'-(5'-chloro)tricyclo[3.3.1.13,7]decan]-4-yl)phenylphosphate), and CSPD (registered-trademark) (disodium 3-(4-methoxyspiro[1,2-dioxetane-3,2-(5'-chloro)tricyclo[3.3.1.13,7]decan]-4-yl) phenylphosphate); luminescent substrates such as p-nitrophenyl phosphate, 5-bromo-4-chloro-3-indolyl phosphate (BLIP), 4-nitro blue tetrazolium chloride (NBT), and iodonitrotetrazolium (INT); fluorescent substrates such as 4-methylumbelliferyl phosphate (4MUP); and chromogenic substrates such as 5-bromo-4-chloro-3-indolyl phosphate (BLIP), disodium 5-bromo-6-chloro-indolyl phosphate, and p-nitrophenyl phosphate; and the like.

The embodiments disclosed herein are merely illustrative in all aspects and should not be considered as being restrictive. The scope of the present invention is defined not by the description of the above embodiments but by the scope of the claims, and includes meaning equivalent to the scope of the claims and all modifications within the scope.

For example, in the above-described embodiment, the body portion 50 among the body portion 50 and the pressing member 361 is moved to align the pressing position with the liquid sealing portion 30. However, instead thereof, the pressing member 361 may be moved to a position vertically above the liquid sealing portion 30 to align the pressing position with the liquid sealing portion 30 or both the body portion 50 and the pressing member 361 may be moved to align the pressing position with the liquid sealing portion 30.

What is claimed is:

1. A liquid-sealed cartridge comprising:

a liquid storage portion configured to store liquid;

a flow path in which the liquid stored in the liquid storage portion flows; and a liquid sealing portion configured to seal the liquid in the liquid storage portion, wherein the liquid sealing portion has an outer circumferential portion and a center-side low strength portion disposed closer to a center than the outer circumferential portion, and the center-side low strength portion is broken when pressed, to allow the liquid in the liquid storage portion to flow in the flow path, and wherein the liquid sealing portion comprises one side portion disposed adjacent to one side of the center-side low strength portion and the other side portion disposed adjacent to the other side of the center-side low strength portion as viewed in a pressing direction, and the one side portion and the other side portion continuously extend from the outer circumferential portion to the center-side low strength portion in the liquid sealing portion, and are deformed by pressing in the pressing direction.

2. The liquid-sealed cartridge of claim 1, wherein the center-side low strength portion is disposed at a center portion of the liquid sealing portion.

3. The liquid-sealed cartridge of claim 1, wherein the center-side low strength portion is broken by pressing and held by at least one of the one side portion and the other side portion.

4. The liquid-sealed cartridge of claim 1, wherein the center-side low strength portion has a thickness less than a thickness of an adjacent region.

5. The liquid-sealed cartridge of claim 1, wherein the center-side low strength portion has at least any one of a linear, a rectangular, a cross-like, and an ellipsoidal planar shape as viewed in a pressing direction.

6. The liquid-sealed cartridge of claim 5, wherein the center-side low strength portion extends, in a first direction, in a center portion of the liquid sealing portion, and the first direction is along a liquid sending direction in which the liquid is sent through the liquid sealing portion.

7. The liquid-sealed cartridge of claim 1, comprising an outer-circumferential-side low strength portion that is formed in the outer circumferential portion and is different from the center side one.

8. The liquid-sealed cartridge of claim 7, wherein the center-side low strength portion has a strength lower than that of the outer-circumferential-side low strength portion.

9. The liquid-sealed cartridge of claim 1, wherein the liquid sealing portion is disposed on an upper face of the liquid storage portion, and a length from the outer circumferential portion of the liquid sealing portion to the center-side low strength portion thereof is less than a depth from the liquid sealing portion to an inner bottom surface of the liquid storage portion.

10. The liquid-sealed cartridge of claim 1, comprising a disk-shaped body portion having the liquid storage portion, the flow path, and the liquid sealing portion formed therein, wherein the liquid storage portion is disposed closer to a center of the body portion than the flow path, and the liquid in the liquid storage portion flows into the flow path by rotating the body portion.

11. The liquid-sealed cartridge of claim 1, wherein the liquid sealing portion is integrated with the liquid storage portion.

12. A liquid-sealed cartridge comprising:

a liquid storage portion configured to store liquid;

a flow path in which the liquid stored in the liquid storage portion flows;

a liquid sealing portion configured to seal the liquid in the liquid storage portion, wherein the liquid sealing portion has an outer circumferential portion and a center-side low strength portion disposed closer to a center than the outer circumferential portion, and the center-side low strength portion is broken when pressed, to allow the liquid in the liquid storage portion to flow in the flow path: and a cover portion opposing the liquid sealing portion, wherein the liquid sealing portion has a pressure-receiving face to be pressed through the cover portion, and the center-side low strength portion is formed by a recess formed on a back side of the pressure-receiving face.

13. A liquid sending method for a liquid-sealed cartridge comprising a liquid storage portion for storing liquid, and a liquid sealing portion for sealing the liquid storage portion, the liquid sending method comprising: pressing a center-side low strength portion of the liquid sealing portion by deforming one side portion on one side of the center-side low strength portion and an other side portion on an other side of the center-side low strength portion in a pressing direction and breaking the liquid sealing portion at the center-side low strength portion, the center-side low strength portion serving as a boundary between the one side portion and the other side portion; and causing the liquid to flow from the liquid storage portion for which the center-side low strength portion has been broken.

14. The liquid sending method of claim 13, wherein the center-side low strength portion has a thickness less than a thickness of a region adjacent to the center-side low strength portion.

15. The liquid sending method of claim 13, wherein the pressing of the center-side low strength portion comprises pressing a portion near a center portion of the liquid sealing portion through a cover portion opposing the liquid sealing portion by a pin-shaped pressing member.

16. The liquid sending method of claim 15, wherein the liquid sealing portion is disposed on an upper face of the liquid storage portion, and the pressing of the center-side low strength portion comprises pressing the liquid sealing portion through the cover portion from above the liquid sealing portion to a position between the liquid sealing portion and an inner bottom surface of the liquid storage portion.

17. The liquid sending method of claim 13, wherein the liquid storage portion is disposed closer to a center of the liquid-sealed cartridge than a flow path, and the causing the liquid to flow comprises rotating the liquid-sealed cartridge such that the liquid in the liquid storage portion flows into the flow path through the center-side low strength portion having been pressed.

* * * * *